US010480363B2

(12) United States Patent
Tsunoda

(10) Patent No.: US 10,480,363 B2
(45) Date of Patent: Nov. 19, 2019

(54) CAM-SWITCHING DEVICE AND METHOD OF CONTROLLING CAM-SWITCHING DEVICE

(71) Applicant: ISUZU MOTORS LIMITED, Shinagawa-ku, Tokyo (JP)

(72) Inventor: Hiroshi Tsunoda, Chigasaki (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 16/069,500

(22) PCT Filed: Jan. 11, 2017

(86) PCT No.: PCT/JP2017/000628
§ 371 (c)(1),
(2) Date: Jul. 11, 2018

(87) PCT Pub. No.: WO2017/122675
PCT Pub. Date: Jul. 20, 2017

(65) Prior Publication Data

US 2019/0010839 A1 Jan. 10, 2019

(30) Foreign Application Priority Data

Jan. 12, 2016 (JP) ..... 2016-003840

(51) Int. Cl.
*F01L 13/00* (2006.01)
*F02B 75/20* (2006.01)
(Continued)

(52) U.S. Cl.
CPC ..... *F01L 13/0036* (2013.01); *F01L 13/00* (2013.01); *F01L 13/0005* (2013.01);
(Continued)

(58) Field of Classification Search
CPC ..... F01L 2001/0473; F01L 1/185; F01L 13/0005; F01L 2013/001;
(Continued)

(56) References Cited

U.S. PATENT DOCUMENTS

2001/0054403 A1 12/2001 Fujii et al.
2009/0071427 A1 3/2009 Mock et al.
2014/0303873 A1 10/2014 Glugla et al.

FOREIGN PATENT DOCUMENTS

DE 102014208950 A2 11/2015
JP 2001-123811 A 5/2001
(Continued)

OTHER PUBLICATIONS

Extended European Search Report for related European Application No. 17738429.4, dated Dec. 3, 2018; 5 pages.
(Continued)

*Primary Examiner* — Jorge L Leon, Jr.
(74) *Attorney, Agent, or Firm* — Procopio, Cory, Hargreaves & Savitch LLP

(57) ABSTRACT

A cam-switching device switches between first and second cams provided so as to correspond to intake exhaust valves of an engine. In a case of switching from the first cam to the second cam, a cylinder resting unit stops the opening and closing operations of the intake and exhaust valves in the same combustion cycle, and a cam shaft moving unit starts sliding the cam shaft in a first cam angle range. In a case of switching from the second cam to the first cam, the cylinder resting unit stops the opening and closing operations of the intake and exhaust valves in the same combustion cycle, and the cam shaft moving unit starts sliding the cam shaft in a second cam angle range.

4 Claims, 10 Drawing Sheets

(51) Int. Cl.
*F02D 13/02* (2006.01)
*F02D 13/06* (2006.01)

(52) U.S. Cl.
CPC ..... *F02B 75/20* (2013.01); *F02D 13/0207* (2013.01); *F02D 13/06* (2013.01); *F01L 2013/001* (2013.01); *F01L 2013/0052* (2013.01); *F01L 2800/00* (2013.01); *F01L 2800/16* (2013.01)

(58) Field of Classification Search
CPC .. F01L 2013/0052; F02B 75/20; F02D 13/06; F02D 17/02; F02D 41/0087
USPC .. 123/90.18, 90.2, 90.27, 90.41, 90.44, 481, 123/198 F
See application file for complete search history.

(56) References Cited

FOREIGN PATENT DOCUMENTS

| | | | | |
|---|---|---|---|---|
| JP | 2002-004823 | A | | 1/2002 |
| JP | 2011-144780 | A | | 7/2011 |
| JP | 2015-172354 | A | | 10/2015 |
| JP | 2015172354 | A | * | 10/2015 |

OTHER PUBLICATIONS

International Search Report and Written Opinion for related International Application No. PCT/JP2017/000628, dated Mar. 7, 2017; English translation of ISR provided; 7 pages.

* cited by examiner

CAM-SWITCHING DEVICE AND METHOD OF CONTROLLING CAM-SWITCHING DEVICE

CROSS-REFERENCE TO RELATED APPLICATIONS

This application is a U.S. National Stage entry of PCT Application No: PCT/JP2017/000628 filed on Jan. 11, 2017, which claims priority to Japanese Patent Application No. 2016-003840, filed Jan. 12, 2016, the contents of which are incorporated herein by reference.

TECHNICAL FIELD

The present disclosure relates to a cam-switching device and particularly relates to a cam-switching device that selectively switches between a pair of cams having different cam profiles which are provided corresponding to each of intake and exhaust valves of an engine to make valve characteristics of the intake and exhaust valves variable, and a method of controlling the cam-switching device.

BACKGROUND ART

In the related art, a cam-switching device is well known in which two kinds of cams having different cam profiles are provided in a cam shaft, and the cam shaft is slid in an axis direction by a hydraulic actuator to selectively switch between the cams such that valve characteristics of intake and exhaust valves are variable (for example, refer to patent literatures 1 and 2).

The intake and exhaust valves are typically urged in valve closing directions by valve springs, respectively, and are opened when a rocker arm that swings by the cams presses the intake and exhaust valves against a restoring force of the valve springs. That is, in a cylinder operation during which the intake and exhaust valves are opened and closed, a contact pressure is applied between the cams and the rocker arm. Therefore, switching between the cams is performed on a base circle of each of the cams where the intake and exhaust valves are not lifted.

CITATION LIST

Patent Document

[Patent Literature 1]: JP-A-2002-4823
[Patent Literature 2]: JP-A-2001-123811

SUMMARY OF THE INVENTION

Technical Problem

The cam-switching device that switches between the cams is required to be provided on each of the intake side and the exhaust side. Therefore, in a case where the cam-switching device is provided per cylinder, the number of cam-switching devices is necessarily two times the number of cylinders, and a configuration thereof is complicated.

Therefore, a configuration of providing the switching device on each of the intake side and the exhaust side and collectively operating the intake side of the plural cylinders and the exhaust side of the plural cylinders is considered. However, an opening and closing timing of a valve is determined per cylinder. Therefore, depending on the number of cylinders or the cam profiles, an angle range of a base circle may be insufficient for switching between the cams. For example, in a case where opening and closing periods of the intake and exhaust valves correspond to an angle range of 120° on the cams, a phase is 120° in a three-cylinder engine. In this case, intake and exhaust valves corresponding to any one of the cylinders are lifted. Therefore, it is difficult to collectively switch between cams corresponding to three cylinders.

An aspect of the present disclosure has been made in consideration of the above-described circumstances, and an object thereof is to provide a cam-switching device and a method of controlling the cam-switching device, in which switching between cams can be performed even in a case where an angle range of a base circle is insufficient for switching between the cams.

Solution to Problem

According to an aspect of the present disclosure for achieving the object, there is provided a cam-switching device that selectively switches between a first cam and a second cam to make valve characteristics of intake and exhaust valves of an engine variable, the first cam and the second cam being provided corresponding to each of the intake and exhaust valves and having different cam profiles, each of the cam profiles being determined such that a first cam angle range where a valve lift amount of the first cam is greater than a valve lift amount of the second cam and a second cam angle range where a valve lift amount of the second cam is greater than a valve lift amount of the first cam are formed, and the cam-switching device including:

a cam shaft configured to rotate in conjunction with a crank shaft of the engine and provided such that the first cam and the second cam are rotatable together;

a cam shaft moving unit configured to slide the cam shaft in an axis direction to selectively switch between the first cam and the second cam;

a cylinder resting unit configured to stop opening and closing operations of the intake and exhaust valves to make a cylinder rentable: and a cam shaft moving control unit configured to control the cylinder resting unit to stop the opening and closing operations of the intake and exhaust valves in the same combustion cycle and control the cam shaft moving unit to start sliding the cam shaft in the first cam angle range in a case of switching from the first cam to the second cam, and to control the cylinder resting unit to stop the opening and closing operations of the intake and exhaust valves in the same combustion cycle and control the cam shaft moving unit to start sliding the cam shaft in the second cam angle range in a case of switching from the second cam to the first cam.

The cam-switching device may further include a rocker arm configured to swing according to the cam profiles of the first cam and the second cam and presses the intake and exhaust valves against a restoring force of a valve spring, in which the cylinder resting unit may cause the rocker arm to swing around a point contacting the intake and exhaust valves as a fulcrum.

In addition, in the cam-switching device, the engine may be an inline multi-cylinder engine in which plural cylinders are arranged in line, the first cam and the second cam may be provided corresponding to each of the intake and exhaust valves of the plural cylinders, the cam shaft moving control unit may control the cylinder resting unit to stop the opening and closing operations of the intake and exhaust valves provided in the plural cylinders in the same combustion cycle, and may control the cam shaft moving unit to start sliding the cam shaft in an axis direction in the first cam angle range that is set for the first cam and the second cam corresponding to one cylinder and is a range where valve lift amounts of the first cam and the second cam corresponding to another cylinder are zero, in a case of switching from the first cam to the second cam, and the cam shaft moving control unit may control the cylinder resting unit to stop the opening and closing operations of the intake and exhaust valves provided in the plural cylinders in the same combustion cycle, and may control the cam shaft moving unit to start sliding the cam shaft in an axis direction in the second cam angle range that is set for the first cam and the second cam corresponding to one cylinder and is a range where valve lift amounts of the first cam and the second cam corresponding to another cylinder are zero, in a case of switching from the second cam to the first cam.

According to another aspect of the present disclosure for achieving the object, there is provided a method of controlling a cam-switching device including a first cam and a second cam provided corresponding to each of intake and exhaust valves of an engine and having different cam profiles, each of the cam profiles being determined such that a first cam angle range where a valve lift amount of the first cam is greater than a valve lift amount of the second cam and a second cam angle range where a valve lift amount of the second cam is greater than a valve lift amount of the first cam are formed, a cam shaft configured to rotate in conjunction with a crank shaft of the engine and provided such that the first cam and the second cam are rotatable together, a cam shaft moving unit configured to slide the cam shaft in an axis direction to selectively switch between the first cam and the second cam, and a cylinder resting unit configured to stop opening and closing operations of the intake and exhaust valves to make a cylinder restable, the method including:

a step of controlling the cylinder resting unit to stop the opening and closing operations of the intake and exhaust valves in the same combustion cycle and controlling the cam shaft moving unit to start sliding the cam shaft in the first cam angle range in a case of switching from the first cam to the second cam; and a step of controlling the cylinder resting unit to stop the opening and closing operations of the intake and exhaust valves in the same combustion cycle and controlling the cam shaft moving unit to start sliding the cam shaft in the second cam angle range in a case of switching from the second cam to the first cam.

Advantageous Effects of the Invention

With the cam-switching device and the method of controlling the cam-switching device according to the present disclosure, switching between cams can be performed even in a case where an angle range of a base circle is insufficient for switching between the cams.

DESCRIPTION OF EMBODIMENTS

Figure 1:
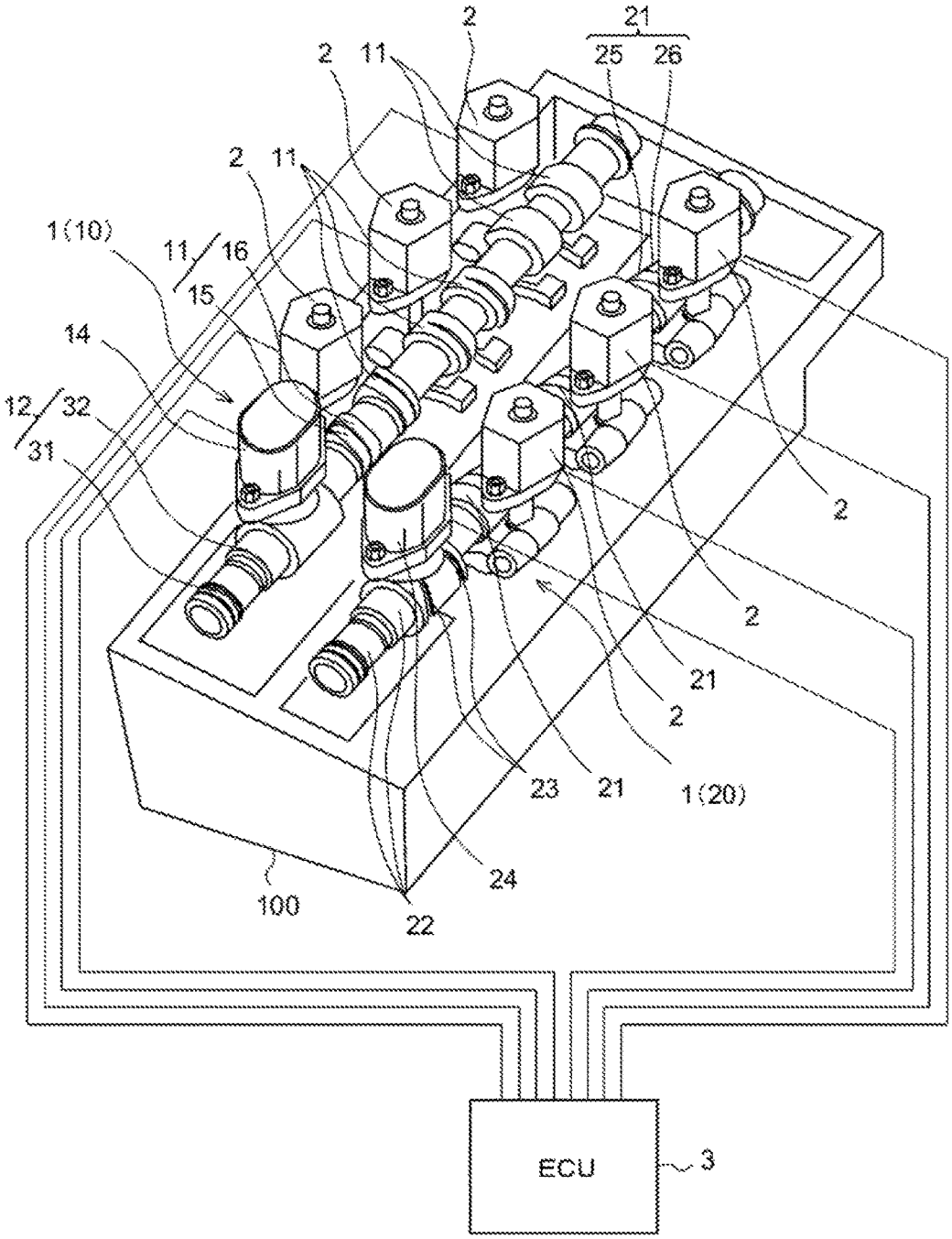
FIG. 1 is a schematic perspective view illustrating a configuration of an upper part of an engine block in a state where a cylinder head cover is removed.

Hereinafter, an embodiment of the present disclosure will be described with reference to the accompanying drawings. An engine 100 illustrated in FIG. 1 is, for example, an inline three-cylinder engine, and includes a cam switching mechanism 1 that selectively switches between a pair of cams (described below) according to an operation state of the engine 100. In addition, in each of cylinders of the engine 100, a cylinder resting mechanism 2 that stops opening and closing operations of intake and exhaust valves to make the cylinder rest is provided. One set of the cam switching mechanism 1, the cylinder resting mechanism 2, and an electronic control unit (ECU) 3 that controls operations of the cam switching mechanism and the cylinder resting mechanism is an example of the cam-switching device according to the present disclosure. For example, the ECU 3 includes a CPU, a ROM, a RAM, an input port, an output port, and the like as well-known. The ECU 3 is an example of the cam shaft moving control unit. A part of functional elements of the ECU 3 can also be provided in separate hardware.

The cam switching mechanism 1 includes an intake-side cam switching mechanism 10 and an exhaust-side cam switching mechanism 20. The intake-side cam switching mechanism 10 includes: an intake-side dual cam shaft 12 in which an intake cam 11 is provided; and an intake-side slide groove (refer to FIGS. 3A and 3B) 13 and an intake-side electromagnetic solenoid 14 that slide the intake-side dual cam shaft 12. The exhaust-side cam switching mechanism 20 includes: an exhaust-side dual cam shaft 22 in which an exhaust cam 21 is provided; and an exhaust-side slide groove 23 and an exhaust-side electromagnetic solenoid 24 that slide the exhaust-side dual cam shaft 22.

Among these, a set of the intake-side slide groove 13 and the intake-side electromagnetic solenoid 14 and a set of the exhaust-side slide groove 23 and the exhaust-side electromagnetic solenoid 24 configure an example of the cam shaft moving unit according to the present disclosure together with the ECU 3. In addition, the intake cam 11 provided in the intake-side dual cam shaft 12 includes two kinds of cams (a standard intake cam 15 and a low-speed cam 16) having different cam profiles. The exhaust cam 21 provided in the exhaust-side dual cam shaft 22 includes two kinds of cams (a fast-opening cam 25 and a standard exhaust cam 26) having different cam profiles. The standard intake cam 15 and the fast-opening cam 25 are examples of the first cam according to the present disclosure, and the low-speed cam 16 and the standard exhaust cam 26 are examples of the second cam according to the present disclosure.

The respective portions included in the exhaust-side cam switching mechanism 20, the exhaust-side dual cam shaft 22, the exhaust-side slide groove 23, and the exhaust-side electromagnetic solenoid 24 have the same configurations as the respective portions of the intake-side cam switching mechanism 10, except that the exhaust cam 21 as a switching target includes the fast-opening cam 25 and the standard exhaust cam 26. Therefore, hereinafter, the intake-side cam switching mechanism 10 will be described, and the description of the exhaust-side cam switching mechanism 20 will not be made.

Figure 2:
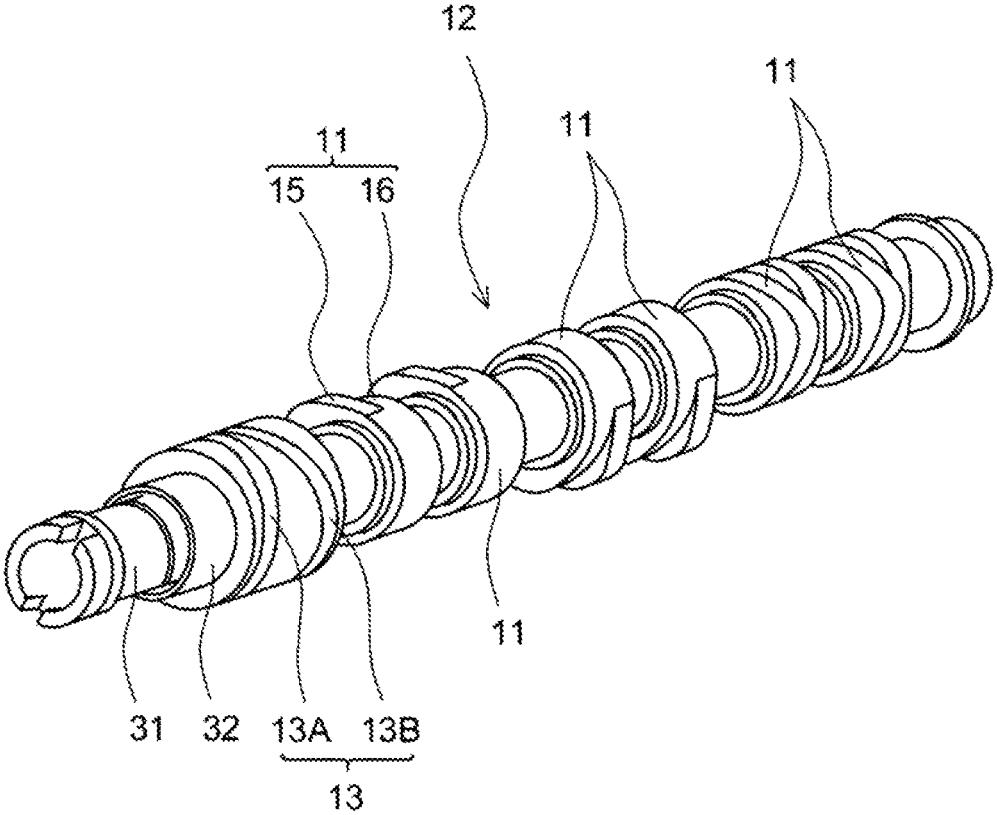
FIG. 2 is a schematic perspective view illustrating an external appearance of a dual cam shaft.

As illustrated in FIG. 2, the intake-side dual cam shaft 12 includes: an inner cam shaft 31 that rotates in conjunction with a crank shaft (not illustrated) of the engine 100; and an outer cam shaft 32 that is spline-fitted to an outer periphery of the inner cam shaft 31 and is slidable in an axis direction relative to the inner cam shaft 31.

Plural intake cams 11 are press-fitted into the outer cam shaft 32 and are attached thereto in a state where they are rotatable together with the outer cam shaft 32. As illustrated in FIG. 1, in the engine 100 according to the embodiment, one cylinder includes two intake valves, and thus six intake valves and six intake cams 11 are provided in total. As illustrated in FIG. 2, each of the intake cams 11 includes the standard intake cam 15 and the low-speed cam 16. By moving the outer cam shaft 32 in the axis direction of the inner cam shaft 31, any one of the standard intake cam 15 and the low-speed cam 16 can be selected. Two intake cams 11 corresponding to the same cylinder are attached such that cam profiles thereof have the same phase. Since the number of cylinders is three, three sets of intake cams 11 are attached in a state where the phases are shifted from each other by 120° per cylinder.

In an end portion of the outer cam shaft 32, two intake-side slide grooves 13 (a first slide groove 13A and a second slide groove 13B) are provided. Shapes of the slide grooves 13A and 13B are formed such that the outer cam shaft 32 starts sliding when cam angles thereof are in predetermined angle ranges described below, respectively. When the outer cam shaft 32 slides in the axis direction of the inner cam shaft 31, switching pins 41A and 41B included in the intake-side electromagnetic solenoid 14 are fitted into the slide grooves 13A and 13B (refer to FIGS. 3A and 4A).

Figure 3A:
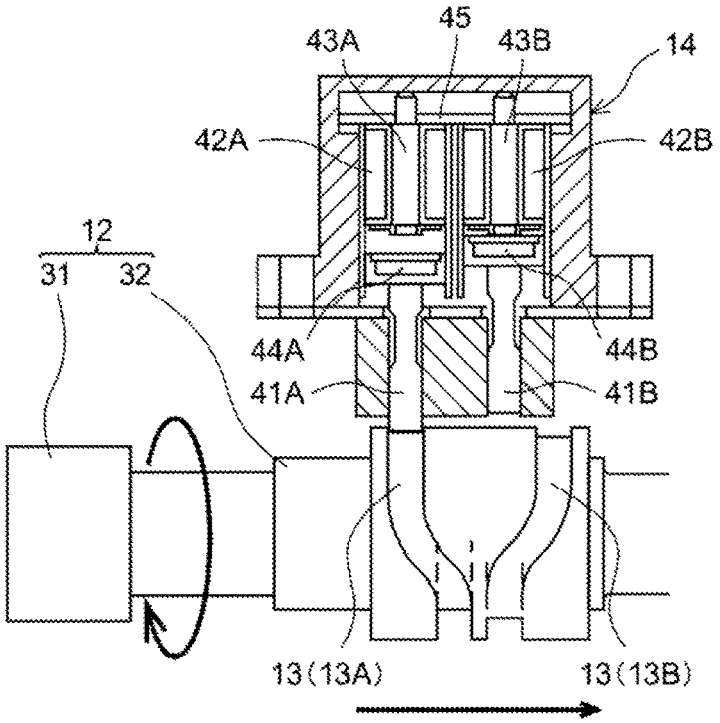
FIG. 3A is a view schematically illustrating the vicinity of an electromagnetic solenoid in a state where a standard intake cam is selected.
Figure 3B:
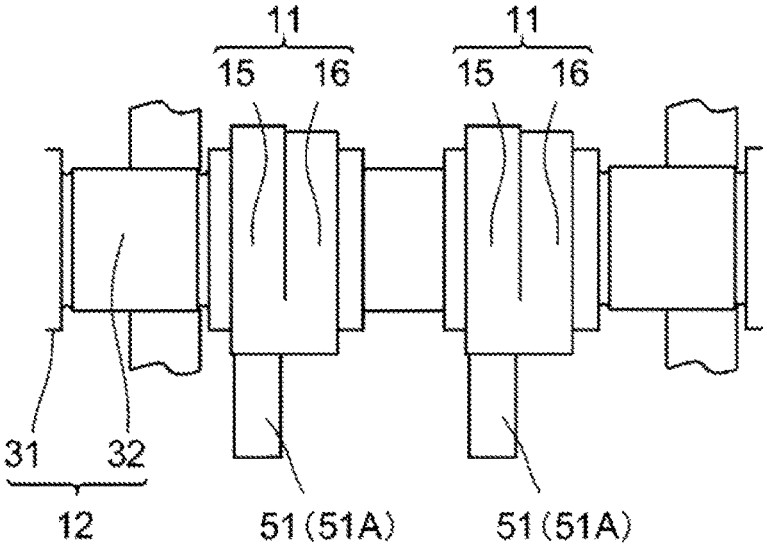
FIG. 3B is a view schematically illustrating a positional relationship between the standard intake cam and a rocker roller.
Figure 4A:
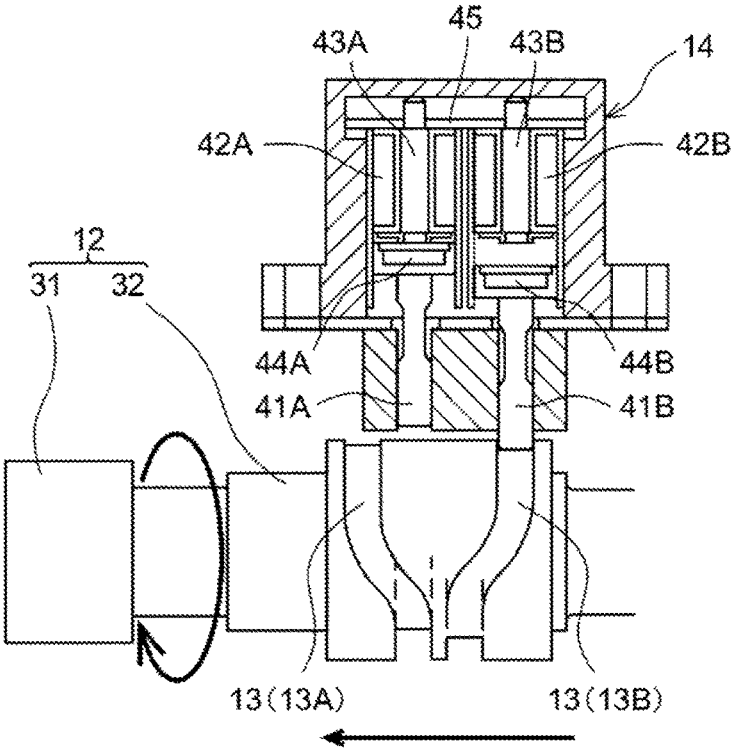
FIG. 4A is a view schematically illustrating the vicinity of the electromagnetic solenoid in a state where a low-speed cam is selected.
Figure 4B:
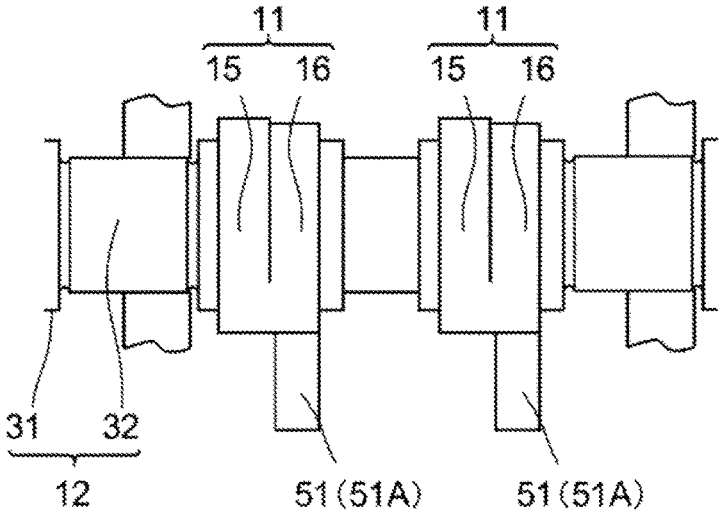
FIG. 4B is a view schematically illustrating a positional relationship between the low-speed cam and the rocker roller.

As illustrated in FIG. 3A, when the standard intake cam 15 is selected, the first switching pin 41A positioned on the left side in FIG. 3A moves downward such that a lower end portion of the first switching pin 41A is fitted to the first slide groove 13A. As a result, as illustrated in FIG. 3B, the outer cam shaft 32 slides to the right side in FIG. 3B such that the standard intake cam 15 included in the intake cam 11 comes into contact with a rocker roller 51A. As illustrated in FIG. 4A, when the low-speed cam 16 is selected, the second switching pin 41B positioned on the left side in FIG. 4A moves downward such that a lower end portion of the second switching pin 41B is fitted to the second slide groove 13B. As a result, as illustrated in FIG. 4B, the outer cam shaft 32 slides to the left side in FIG. 4B such that the low-speed cam 16 included in the intake cam 11 comes into contact with the rocker roller 51A.

As illustrated in FIGS. 3A and 4A, the movement of the first switching pin 41A and the second switching pin 41B in the up-down direction is controlled by the intake-side electromagnetic solenoid 14. Specifically, the movement is controlled by applying a current to a first electromagnetic solenoid 42A positioned on the first switching pin 41A and a second electromagnetic solenoid 42B positioned on the second switching pin 41B.

A first iron core 43A is disposed at the center of the first electromagnetic solenoid 42A, and a lower end of the first iron core 43A is an N pole during current carrying to the first electromagnetic solenoid 42A. In an upper end portion of the first switching pin 41A, a first permanent magnet 44A having an upper surface as an N pole is provided. Likewise, a second iron core 43B is disposed at the center of the second electromagnetic solenoid 42B, and a lower end of the second iron core 43B is an S pole during current carrying to the second electromagnetic solenoid 42B. In an upper end portion of the second switching pin 41B, a second permanent magnet 44B having an upper surface as an S pole is provided. Further, upper end portions of the first iron core 43A and the second iron core 43B connected to each other through a yoke 45 formed of a plate-shaped magnetic permeable material.

As illustrated in FIG. 3A, in a case where a current is applied to the first electromagnetic solenoid 42A and current carrying to the second electromagnetic solenoid 42B is stopped, the lower end of the first iron core 43A is an N pole and is repulsive against the first permanent magnet 44A. Therefore, the first switching pin 41A moves downward. On the other hand, in a case where current carrying to the second electromagnetic solenoid 42B is stopped, the lower end of the second iron core 43B is magnetized into an N pole by a magnetic field from the first iron core 43A and is attracted to the second permanent magnet 44B. Therefore, the second switching pin 41B is adsorbed on the lower end of the second iron core 43B.

As illustrated in FIG. 4A, in a case where a current is applied to the second electromagnetic solenoid 42B and current carrying to the first electromagnetic solenoid 42A is stopped, the lower end of the second iron core 43B is an S pole and is repulsive against the second permanent magnet 44B. Therefore, the second switching pin 41B moves downward. On the other hand, current carrying to the first electromagnetic solenoid 42A is stopped, and the lower end of the first iron core 43A is magnetized to an S pole by a magnetic field from the second iron core 43B and is attracted to the first permanent magnet 44A. Therefore, the first switching pin 41A is adsorbed on the lower end of the first iron core 43A.

Accordingly, by selectively performing the current carrying to the first electromagnetic solenoid 42A and the current carrying to the second electromagnetic solenoid 42B, the first switching pin 41A and the second switching pin 41B can be selectively fitted to the first slide groove 13A and the second slide groove 13B, and the standard intake cam 15 and the low-speed cam 16 can be selectively brought into contact with the rocker roller 51A.

Figure 5:
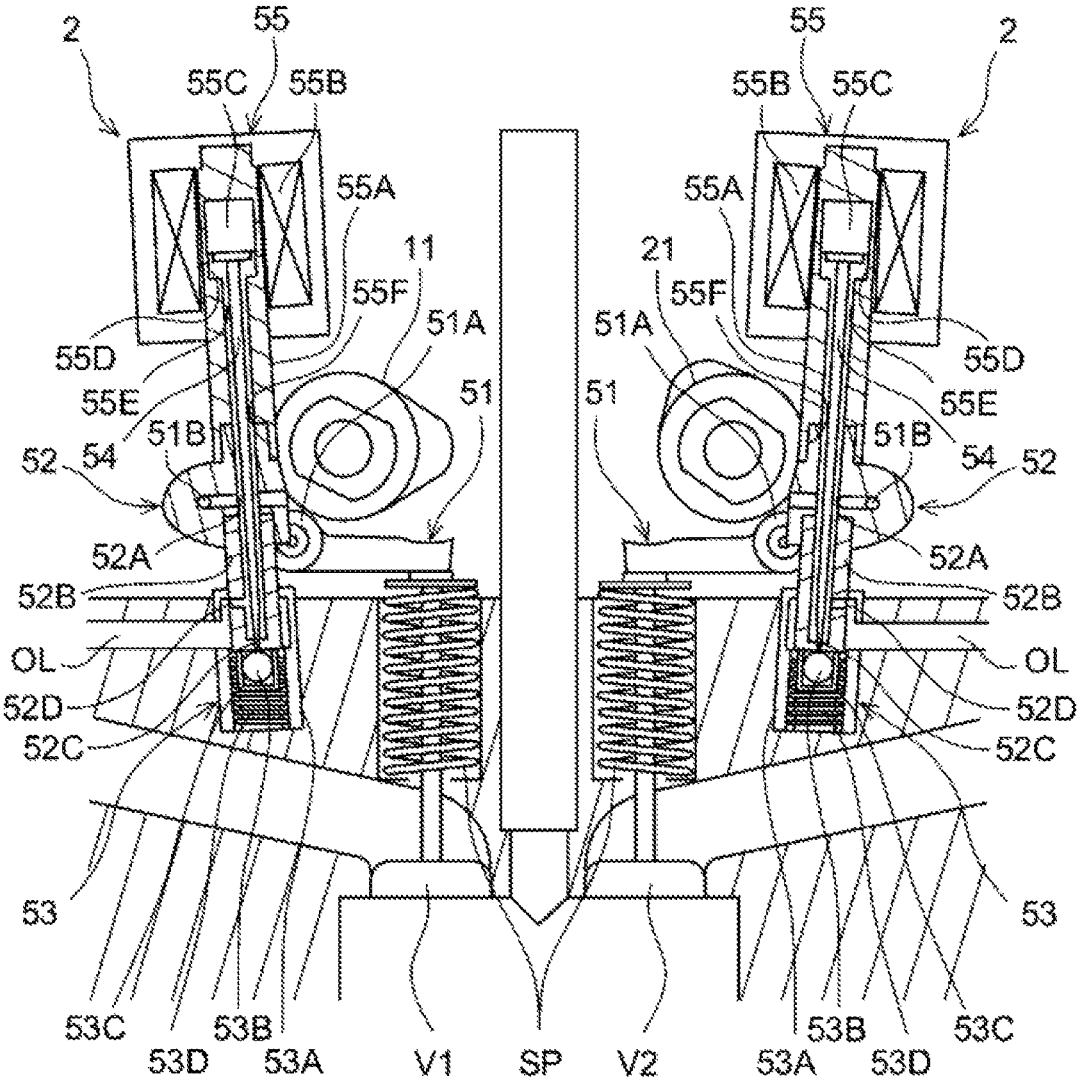
FIG. 5 is a schematic cross-sectional view illustrating a configuration of intake and exhaust valves and the vicinity thereof.

Next, the cylinder resting mechanism 2 will be described. The cylinder resting mechanism 2 is a mechanism that closes the intake and exhaust valves to make the cylinder rest, and configures the cylinder resting unit according to the present disclosure together with the ECU 3. As illustrated in FIG. 5, the cylinder resting mechanism 2 includes a rocker arm 51, a bracket 52, a hydraulic tappet 53, a needle 54, and an electromagnetic solenoid 55 for resting.

The rocker arm 51 is a member that is swung by the intake cam 11 (the standard intake cam 15 and the low-speed cam 16) or the exhaust cam 21 (the standard exhaust cam 26 and the fast-opening cam 25) to operate an intake valve V1 or an exhaust valve V2 in a valve opening direction. One end portion of the rocker arm 51 is attached in a state where it is rotatable around the rocker shaft axis 51B with respect to the bracket 52. The other end portion of the rocker arm 51 comes into contact with an upper end of the intake valve V1 or the exhaust valve V2 from above. The rocker roller 51A contacting the intake cam 11 or the exhaust cam 21 may be formed in the middle of the rocker arm 51 in a longitudinal direction.

The bracket 52 is a member that is connected to the rocker arm 51 on the rocker shaft axis 51B by pin-connection and moves up and down according to the swinging of the rocker arm 51 in a state where the cylinder rests. The needle 54 is stored in the bracket 52, and a needle storage space 52A filled with engine oil is formed in the bracket 52. A lower portion of the bracket 52 forms a piston portion 52B having a bottomed cylindrical shape that advances and retreats relative to the hydraulic tappet 53. In a bottom surface center portion of the piston portion 52B, an oil gallery 52C that forms a passage of the engine oil and into which a tip portion of the needle 54 is inserted is formed in a state where it penetrates the bottom surface center portion in a plate thickness direction. In addition, in a side surface of the piston portion 52B, a communication hole 52D through which an oil passage OL and the needle storage space 52A filled with the engine oil is formed.

The hydraulic tappet 53 is a member into which the piston portion 52B of the bracket 52 is retreatably inserted and that supports the bracket 52 (the piston portion 52B) from below, and includes: a cylindrical body 53A; a check ball 53B that is urged upward by a check ball spring (not illustrated); a storage portion 53C having a bottomed cylindrical shape that comes into contact with a lower end surface of the piston portion 52B and stores the check ball 53B and the check ball spring; a piston spring 53D that supports the storage portion 53C from below.

In a state where the cylinder operates, in the hydraulic tappet 53, the check ball 53B is urged upward such that the oil gallery 52C of the piston portion 52B is blocked by the check ball 53B. In a state where the oil gallery 52C is blocked, the engine oil that fills a region below the piston portion 52B cannot flow. Therefore, the bracket 52 (the piston portion 52B) cannot move down, and a position thereof in a height direction is fixed.

On the other hand, in a state where the cylinder rests, in the hydraulic tappet 53, the check ball 53B is moved down by the needle 54 such that the oil gallery 52C of the piston portion 52B is opened. In a state where the oil gallery 52C is opened, the engine oil that fills a region below the piston portion 52B can flow to the inside of the needle storage space 52A through the oil gallery 52C. The engine oil in the needle storage space 52A can flow to the oil passage OL from the communication hole 52D that is formed in the side surface of the piston portion 52B. Therefore, in a case where the oil gallery 52C is opened, the bracket 52 (piston portion 52B) can move down. That is, in a case where a pressing force of the cams 11 and 21 is higher than a restoring force of the piston spring 53D, the piston spring 53D contracts such that the bracket 52 moves down. In a case where the pressing force of the cams 11 and 21 is lower than the restoring force of the piston spring 53D, the bracket 52 moves up by the restoring force of the piston spring 53D.

The needle 54 is a rod-shaped member for moving the check ball 53B down and is stored in the needle storage space 52A of the bracket 52 in a state where it is movable in the axis direction, and a lower end thereof is in contact with the check ball 53B. An upper end portion of the needle 54 is stored in the electromagnetic solenoid 55 for resting, and moves in the up-down direction by a plunger 55C included in the electromagnetic solenoid 55 for resting.

The electromagnetic solenoid 55 for resting includes a guide shaft 55A, a coil 55B for resting, and the plunger 55C.

The guide shaft 55A is a cylindrical member having a blocked upper end, in which a plunger storage space 55D that stores the plunger 55C in a state where it is movable in the axis direction of the needle 54 is formed in an upper end portion, and a needle storage space 55E that stores the needle 54 in a state where it is movable in the axis direction is formed below the storage space 55D. Further, in a lower end portion of the guide shaft 55A, a guide space 55F to which an upper end portion of the bracket 52 is fitted in a state where it is slidable in the axis direction of the needle 54 is formed.

The coil 55B for resting is disposed in an upper end portion of the guide shaft 55A and urges the plunger 55C downward by applying a current to generate a magnetic field. The plunger 55C comes into contact with the upper end of the needle 54 from above, and presses the needle 54 down by the magnetic field generated from the coil 55B for resting. In a case where the current carrying to the coil 55B for resting is stopped, the generation of the magnetic field is stopped. Therefore, the check ball 53B is moved up by the restoring force of the check ball spring, and thus the needle 54 and the plunger 55C are also moved up.

In the cylinder resting mechanism 2 having the above-described configuration, current carrying to the electromagnetic solenoid 55 for resting (the coil 55B for resting) is stopped in a state where the cylinder operates, and a current is applied to the electromagnetic solenoid 55 for resting in a state where the cylinder rests.

In a state where current carrying to the electromagnetic solenoid 55 for resting is stopped, the check ball 53B is moved up such that the oil gallery 52C of the piston portion 52B is blocked. As a result, the height position of the bracket 52 is fixed. In a case where the rocker roller 51A is pressed along the cam profile of the intake cam 11 or the exhaust cam 21, one end portion of the rocker arm 51 rotates around the rocker shaft axis 51B as a fulcrum, and the other end portion of the rocker arm 51 swings against a restoring force of the valve spring SP. As a result, the intake valve V1 or the exhaust valve V2 is opened or closed.

In a state where a current is applied to the electromagnetic solenoid 55 for resting, the check ball 53B is moved down such that the oil gallery 52C of the piston portion 52B is opened. As a result, the bracket 52 is movable in the up-down direction (the axis direction of the needle 54). In a case where the rocker roller 51A is pressed along the cam profile of the intake cam 11 or the exhaust cam 21, the restoring force of the valve spring SP is strong. Therefore, the other end portion of the rocker arm 51 rotates around an upper end of the intake valve V1 or an upper end of the exhaust valve V2 as a fulcrum, and the one end portion of the rocker arm 51 swings in the up-down direction through the rocker shaft axis 51B together with the bracket 52. Therefore, even in a case where the rocker arm 51 swings, the intake valve V1 or the exhaust valve V2 is maintained in a closed state.

Next, the cam profiles of the intake cam 11 and the exhaust cam 21 will be described with reference to FIGS. 6A and 6B.

Figure 6A:
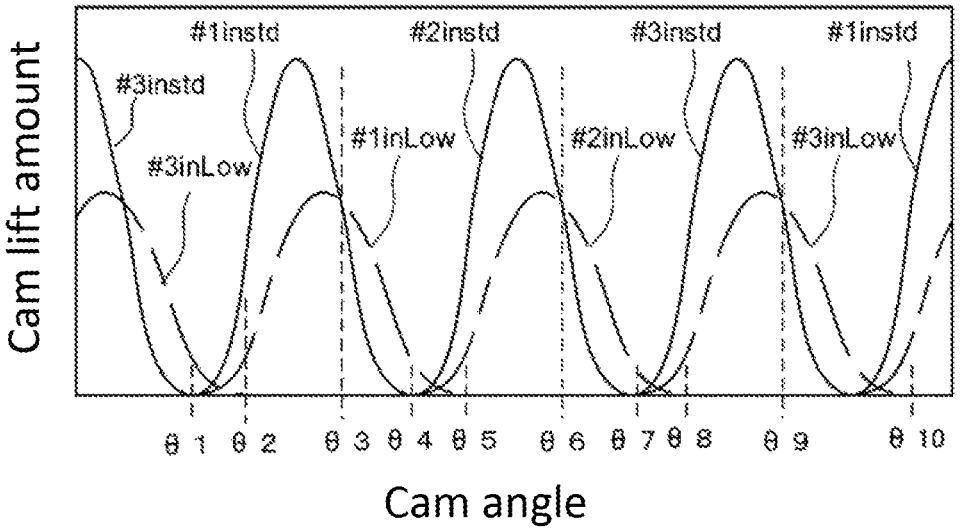
FIG. 6A is a diagram schematically illustrating a relationship between a cam angle and a cam lift amount of an intake cam.

As illustrated in FIG. 6A, in the intake cam 11 of a first cylinder #1, in an angle range from a cam angle θ1 to a cam angle θ3, a cam profile #$\mathbf{1}_{instd}$ of the standard intake cam 15 has a greater cam lift amount than a cam profile #$\mathbf{1}_{inLow}$ of the low-speed cam 16. On the other hand, in an angle range from a cam angle θ3 to a cam angle θ5, the cam profile #$\mathbf{1}_{inLow}$ of the low-speed cam 16 has a greater cam lift amount than the cam profile #$\mathbf{1}_{instd}$ of the standard intake cam 15.

In the intake cam 11 of a second cylinder #2, in an angle range from a cam angle θ4 to a cam angle θ6, a cam profile #$\mathbf{2}_{instd}$ of the standard intake cam 15 has a greater cam lift amount than a cam profile #$\mathbf{2}_{inLow}$ of the low-speed cam 16. On the other hand, in an angle range from a cam angle θ6 to a cam angle θ8, the cam profile #$\mathbf{2}_{inLow}$ of the low-speed cam 16 has a greater cam lift amount than the cam profile #$\mathbf{2}_{instd}$ of the standard intake cam 15.

In the intake cam 11 of a third cylinder #3, in an angle range from a cam angle θ7 to a cam angle θ9, a cam profile #$\mathbf{3}_{instd}$ of the standard intake cam 15 has a greater cam lift amount than a cam profile #$\mathbf{3}_{inLow}$ of the low-speed cam 16. On the other hand, in an angle range from a cam angle θ9 to a cam angle θ10, the cam profile #$\mathbf{3}_{inLow}$ of the low-speed cam 16 has a greater cam lift amount than the cam profile #$\mathbf{3}_{instd}$ of the standard intake cam 15.

It can be seen from FIG. 6A that, even when any cam angle is selected in the intake cam 11 according to the embodiment, the intake valve V1 of any one of the cylinders is lifted and an angle range of a base circle included in the intake cam 11 is insufficient for switching between the standard intake cam 15 and the low-speed cam 16.

In the example of FIG. 6A, the angle range from the cam angle θ1 to the cam angle θ3, the angle range from the cam angle θ4 to the cam angle θ6, and the angle range from the cam angle θ7 to the cam angle θ9 correspond to the first angle range according to the present disclosure. In addition, the angle range from the cam angle θ3 to the cam angle θ5, the angle range from the cam angle θ6 to the cam angle θ8, and the angle range from the cam angle θ9 to the cam angle θ10 correspond to the second angle range according to the present disclosure. In the embodiment, the first angle range includes a range where the cam lift amounts of the other cylinders are not zero. Therefore, during switching from the standard intake cam 15 to the low-speed cam 16, in the first angle range that is a range where the cam lift amounts of the other cylinders are zero, for example, in the range from the cam angle θ2 to the cam angle θ3 in the case of the first cylinder #1, the outer cam shaft 32 starts sliding. In addition, the second angle range includes a range where the cam lift amounts of the other cylinders are not zero. Therefore, during switching from the low-speed cam 16 to the standard intake cam 15, in the second angle range that is a range where the cam lift amounts of the other cylinders are zero, for example, in the range from the cam angle θ3 to the cam angle θ4 in the case of the first cylinder #1, the outer cam shaft 32 starts sliding.

Figure 6B:
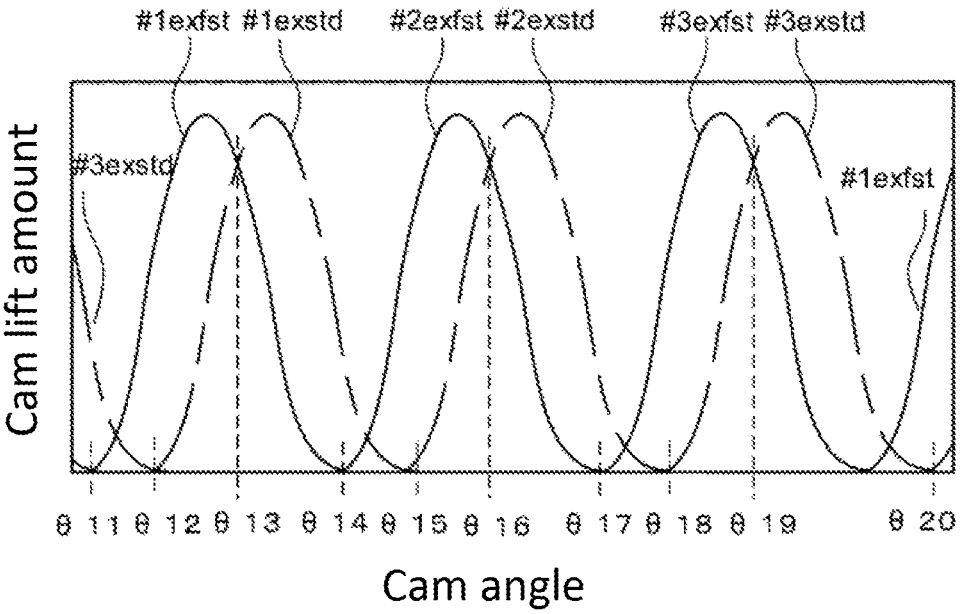
FIG. 6B is a diagram schematically illustrating a relationship between a cam angle and a cam lift amount of an exhaust cam.

As illustrated in FIG. 6B, in the exhaust cam 21 of the first cylinder #1, in an angle range from a cam angle θ11 to a cam angle θ13, a cam profile #$\mathbf{1}_{exfst}$ of the fast-opening cam 25 has a greater cam lift amount than a cam profile #$\mathbf{1}_{exstd}$ of the standard exhaust cam 26. On the other hand, in an angle range from a cam angle θ13 to a cam angle θ15, the cam profile #$\mathbf{1}_{exstd}$ of the standard exhaust cam 26 has a greater cam lift amount than the cam profile #$\mathbf{1}_{exfst}$ of the fast-opening cam 25.

In the exhaust cam 21 of the second cylinder #2, in an angle range from a cam angle θ14 to a cam angle θ16, a cam profile #$\mathbf{2}_{exfst}$ of the fast-opening cam 25 has a greater cam lift amount than a cam profile #$\mathbf{2}_{exstd}$ of the standard exhaust cam 26. On the other hand, in an angle range from a cam angle θ16 to a cam angle θ18, the cam profile #$\mathbf{2}_{exstd}$ of the standard exhaust cam 26 has a greater cam lift amount than the cam profile #$\mathbf{2}_{exfst}$ of the fast-opening cam 25.

In the exhaust cam 21 of the third cylinder #3, in an angle range from a cam angle θ17 to a cam angle θ19, a cam profile #$\mathbf{3}_{exfst}$ of the fast-opening cam 25 has a greater cam lift amount than a cam profile #$\mathbf{3}_{exstd}$ of the standard exhaust cam 26. On the other hand, in an angle range from a cam angle θ19 to a cam angle θ20, the cam profile #$\mathbf{3}_{exstd}$ of the standard exhaust cam 26 has a greater cam lift amount than the cam profile #$\mathbf{3}_{exfst}$ of the fast-opening cam 25.

It can be seen from FIG. 6B that, even when any cam angle is selected in the exhaust cam 21 according to the embodiment, the exhaust valve V2 of any one of the cylinders is lifted and an angle range of a base circle included in the exhaust cam 21 is insufficient for switching between the fast-opening cam 25 and the standard exhaust cam 26.

In the example of FIG. 6B, the angle range from the cam angle θ11 to the cam angle θ13, the angle range from the cam angle θ14 to the cam angle θ16, and the angle range from the cam angle θ17 to the cam angle θ19 correspond to the first angle range according to the present disclosure. In addition, the angle range from the cam angle θ13 to the cam angle θ15, the angle range from the cam angle θ16 to the cam angle θ18, and the angle range from the cam angle θ19 to the cam angle θ20 correspond to the second angle range according to the present disclosure. In the embodiment, the first angle range includes a range where the cam lift amounts of the other cylinders are not zero. Therefore, during switching from the fast-opening cam 25 to the standard exhaust cam 26, in the first angle range that is a range where the cam lift amounts of the other cylinders are zero, for example, in the range from the cam angle θ12 to the cam angle θ13 in the case of the first cylinder #1, the outer cam shaft starts sliding. In addition, the second angle range includes a range where the cam lift amounts of the other cylinders are not zero. Therefore, during switching from the standard exhaust cam 26 to the fast-opening cam 25, in the second angle range that is a range where the cam lift amounts of the other cylinders are zero, for example, in the range from the cam angle θ13 to the cam angle θ14 in the case of the first cylinder #1, the outer cam shaft starts sliding.

Next, a switching control of the cams using the ECU 3 will be described.

First, a switching control from the standard intake cam 15 to the low-speed cam 16 will be described with reference to FIG. 7. In a timing chart of FIG. 7, the horizontal axis represents the time. The description will be made in order from the upper stage of FIG. 7. Switching Req (switching request signal) is a timing signal representing a switching request from the standard intake cam 15 to the low-speed cam 16. The switching request is output as an H-level signal in a case where the ECU 3 detects that predetermined conditions are satisfied. IN-CAM1$x$ is a timing signal representing the start of each cycle in a case where an intake control on the three cylinders is set as one cycle. IN-CAM3$x$ is a timing signal representing the start of a control on each of the cylinders in one cycle period.

#1IN-Rest is a control signal that is at an H-level over a cylinder resting period of the intake valve V1 of the first cylinder #1. #1IN-Lift Amount is a signal schematically representing the lift amount of a pair of intake valves V1 provided in the first cylinder #1. #2IN-Rest is a control signal that is at an H-level over a cylinder resting period of the intake valve V1 of the second cylinder #2. #2IN-Lift Amount is a signal schematically representing the lift amount of a pair of intake valves V1 provided in the second cylinder #2. #3IN-Rest is a control signal that is at an H-level over a cylinder resting period of the intake valve V1 of the third cylinder #3. #3IN-Lift Amount is a signal schematically representing the lift amount of a pair of intake valves V1 provided in the third cylinder #3.

First IN-SOL is a signal representing the capacity of a current applied to the first electromagnetic solenoid 42A. Second IN-SOL is a signal representing the capacity of a current applied to the second electromagnetic solenoid 42B. In the example of FIG. 7, the intake cam is switched from the standard intake cam 15 to the low-speed cam 16, and thus a current is applied to the second electromagnetic solenoid 42B.

EX-CAM1*x* is a timing signal representing the start of each cycle in a case where an exhaust control on the three cylinders is set as one cycle. EX-CAM3*x* is a timing signal representing the start of a control on each of the cylinders in one cycle period.

#1EX-Rest is a control signal that is at an H-level over a cylinder resting period of the exhaust valve V2 of the first cylinder #1. #1EX-Lift Amount is a signal schematically representing the lift amount of a pair of exhaust valves V2 provided in the first cylinder #1. #2EX-Rest is a control signal that is at an H-level over a cylinder resting period of the exhaust valve V2 of the second cylinder #2. #2EX-Lift Amount is a signal schematically representing the lift amount of a pair of exhaust valves V2 provided in the second cylinder #2. #3EX-Rest is a control signal that is at an H-level over a cylinder resting period of the exhaust valve V2 of the third cylinder #3. #3EX-Lift Amount is a signal schematically representing the lift amount of a pair of exhaust valves V2 provided in the third cylinder #3.

The ECU 3 monitors the switching request signal and recognizes that a switching request from the standard intake cam 15 to the low-speed cam 16 is given based on a change in the voltage level of the switching request signal. In the example of FIG. 7, the ECU 3 recognizes that the switching request is given at a falling timing (time t1) from an H-level to an L-level.

In a case where the switching request from the standard intake cam 15 to the low-speed cam 16 is recognized, the ECU 3 sequentially makes each of the cylinders #1 to #3 rest. Therefore, the ECU 3 recognizes that a control start timing of the next period is reached based on the timing signal IN-CAM1*x* (time t2), and then applies a current to the electromagnetic solenoid 55 for resting (the coil 55B for resting) corresponding to the intake valve V1 of the first cylinder #1 based on the timing signal IN-CAM3*x* (time t3). As a result, regarding the first cylinder #1, even in a case where the rocker arm 51 swings, the intake valve V1 is maintained in a closed state.

Next, the ECU 3 applies a current to the electromagnetic solenoid 55 for resting corresponding to the intake valve V1 of the second cylinder #2 based on the timing signal IN-CAM3*x* (time t4). As a result, regarding the second cylinder #2, even in a case where the rocker arm 51 swings, the intake valve V1 is maintained in a closed state. Likewise, the ECU 3 applies a current to the electromagnetic solenoid 55 for resting corresponding to the intake valve V1 of the third cylinder #3 based on the timing signal IN-CAM3*x* (time t6). As a result, regarding the third cylinder #3, even in a case where the rocker arm 51 swings, the intake valve V1 is maintained in a closed state. At time t6, each of the cylinders #1 to #3 is made to rest.

The ECU 3 starts applying a current to the second electromagnetic solenoid 42B at time t6. By applying a current to the second electromagnetic solenoid 42B, the second switching pin 41B moves down such that the lower end portion is fitted to the second slide groove 13B. As a result, the outer cam shaft 32 starts sliding along the second slide groove 13B, that is, starts sliding in the angle range from the cam angle θ2 to the cam angle θ3 such that a relative position between the intake cam 11 and the rocker roller 51A changes. Specifically, the intake cam 11 is moved such that a part of the rocker roller 51A is positioned on the low-speed cam 16 from a state where the rocker roller 51A and the standard intake cam 15 are in contact with each other.

Here, as illustrated in FIG. 6A, in the angle range from the cam angle θ2 to the cam angle θ3, the cam lift amount of the standard intake cam 15 is greater than that of the low-speed cam 16. That is, the low-speed cam 16 is positioned at a position (position close to the rotation center) lower than the standard intake cam 15. Therefore, the intake cam 11 can be smoothly slid without being hindered by a step difference between a cam surface of the standard intake cam 15 and a cam surface of the low-speed cam 16. The opening and closing operation of the intake valve V1 included in each of the cylinders is stopped. Therefore, even in a case where the rocker roller 51A falls from the step difference between the standard intake cam 15 and the low-speed cam 16, the rocker arm 51 moves in the up-down direction together with the bracket 52 such that the swinging of the rocker arm 51 is absorbed. As a result, the cam can be switched while preventing the generation of an abnormal sound.

As can be seen from FIG. 6A, the cam lift amounts of the intake cams 11 of the second cylinder #2 and the third cylinder #3 are zero in the angle range of the cam angle θ2 to the cam angle θ3. That is, the base circles of the intake cams 11 come into contact with the rocker roller 51A. Therefore, the intake cams 11 of the second cylinder #2 and the third cylinder #3 can be switched from the standard intake cams 15 to the low-speed cams 16.

Figure 7:
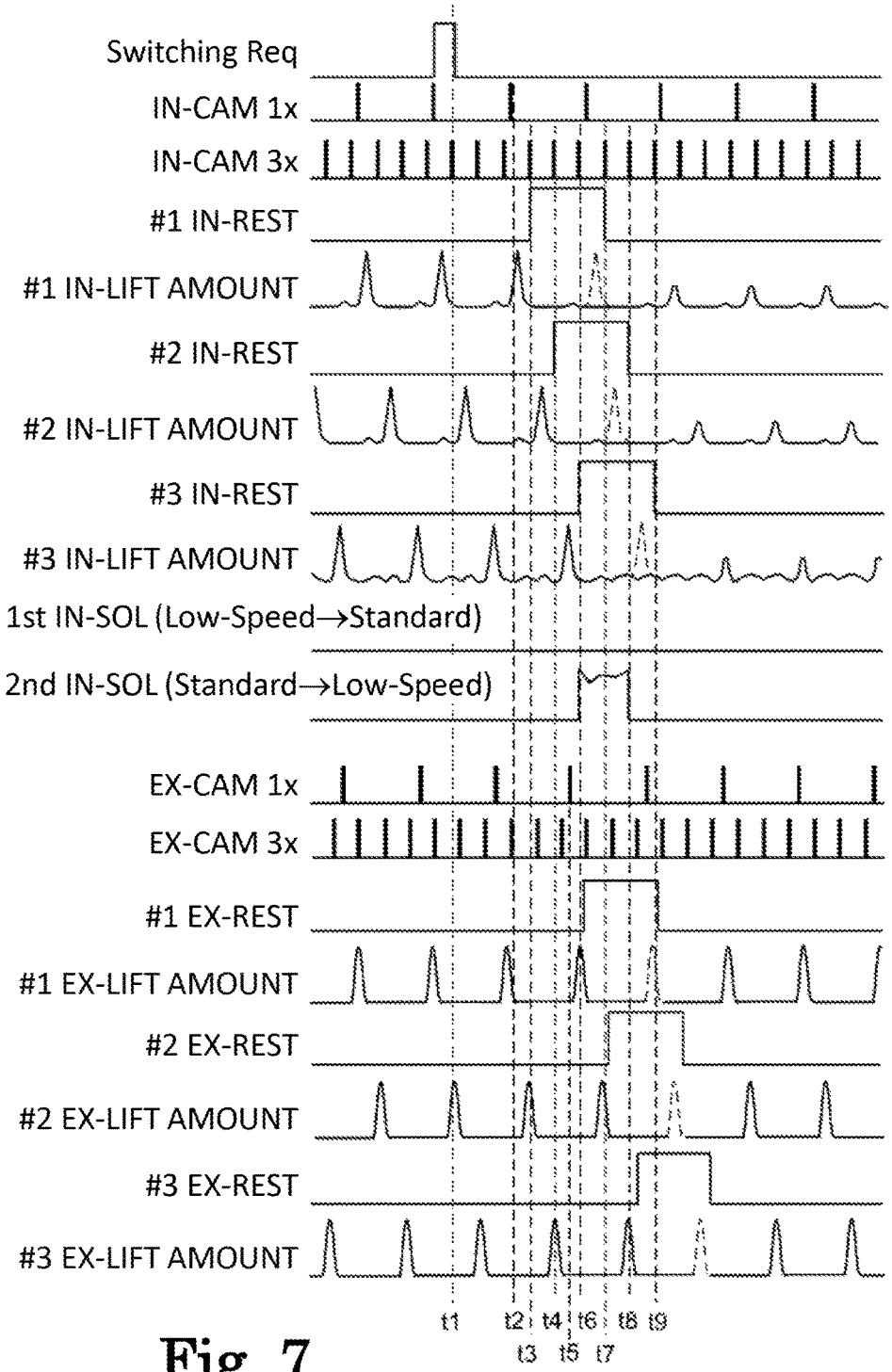
FIG. 7 is a timing chart illustrating switching from the standard cam to the low-speed cam in the intake cam.

Next, as illustrated in FIG. 7, at time t7, current carrying to the electromagnetic solenoid 55 for resting corresponding to the intake valve V1 of the first cylinder #1 is stopped, and the intake valve V1 is switched to an operation state. At this time, at least a part of the rocker roller 51A is positioned on the low-speed cam 16. As a result, the opening and closing operation of the intake valve V1 of the first cylinder #1 starts smoothly according to the cam profile of the low-speed cam 16.

Next, at time t8, current carrying to the electromagnetic solenoid 55 for resting corresponding to the intake valve V1 of the second cylinder #2 is stopped. At time t9, current carrying to the electromagnetic solenoid 55 for resting corresponding to the intake valve V1 of the third cylinder #3 is stopped, and the intake valve V1 included in each of the cylinders #2 and #3 is switched to an operation state. Regarding the cylinders #2 and #3, at least a part of the rocker roller 51A is positioned on the low-speed cam 16. Therefore, the opening and closing operation of the intake valve V1 starts smoothly according to the cam profile of the low-speed cam 16.

In addition, in a case where the ECU 3 recognizes that an intake control start timing of the next period is reached based on the timing signal IN-CAM1$x$ (at time t2), the ECU recognizes that an exhaust control start timing of the next period is reached based on the timing signal EX-CAM1$x$. Here, the intake control of the next period and the exhaust control of the next period are an intake control and an exhaust control in the same combustion cycle. Here, for example, in the case of a four-stroke engine, the combustion cycle refers to a cycle including four steps of an intake step, a compression step, a combustion step, and an exhaust step. In addition, the intake control and the exhaust control in the same combustion cycle refer to an intake control and an exhaust control that are performed in one combustion cycle.

In a case where the ECU 3 recognizes that an exhaust control start timing of the next period is reached based on the timing signal EX-CAM1$x$ (at time t5), the ECU 3 sequentially applies a current to the electromagnetic solenoid 55 for resting (the coil 55B for resting) corresponding to the exhaust valve V2 of the first cylinder #1, the electromagnetic solenoid 55 for resting corresponding to the exhaust valve V2 of the second cylinder #2, and the electromagnetic solenoid 55 for resting corresponding to the exhaust valve V2 of the third cylinder #3 based on the timing signal EX-CAM3$x$. As a result, regarding the first cylinder #1, the second cylinder #2, and the third cylinder #3, even in a case where the rocker arm 51 swings, the exhaust valve V2 is maintained in a closed state.

Next, the ECU sequentially stops current carrying to the electromagnetic solenoid 55 for resting corresponding to the exhaust valve V2 of the first cylinder #1, the electromagnetic solenoid 55 for resting corresponding to the exhaust valve V2 of the second cylinder #2, and the electromagnetic solenoid 55 for resting corresponding to the exhaust valve V2 of the third cylinder #3, and the exhaust valve V2 is switched to an operation state.

In a case where the operation of the intake valve V1 is stopped in the switching control from the standard intake cam 15 to the low-speed cam 16, the operation of the exhaust valve V2 in the same combustion cycle can be appropriately stopped. That is, in a combustion cycle in which the intake valve V1 does not operate and air is not taken in, the exhaust valve V2 does not operate. As a result, the backflow of exhaust gas from an exhaust downstream side into a combustion chamber can be prevented, the backflow being caused when the exhaust valve V2 opens although air is not taken in in the combustion cycle. Therefore, a rotational resistance to the engine can be prevented, and deterioration of fuel efficiency can be prevented.

Next, a switching control from the low-speed cam 16 to the standard intake cam 15 will be described with reference to FIG. 8. Among respective items of the horizontal axis and the vertical axis in a timing chart of FIG. 8, the same items as those of FIG. 7 will not be described.

Switching Req (switching request signal) is a timing signal representing a switching request from the low-speed cam 16 to the standard intake cam 15.

The ECU 3 monitors the switching request signal and recognizes that a switching request from the low-speed cam 16 to the standard intake cam 15 is given based on a change in the voltage level of the switching request signal. The ECU 3 recognizes that the switching request is given at time t11.

In a case where the switching request from the low-speed cam 16 to the standard intake cam 15 is recognized, the ECU 3 sequentially makes each of the cylinders rest. Therefore, the ECU 3 recognizes that a control start timing of the next period is reached based on the timing signal IN-CAM1$x$ (time t12), and then applies a current to the electromagnetic solenoid 55 for resting corresponding to each of the cylinders #1 to #3 based on the timing signal IN-CAM3$x$ (times t13, t14, t16).

The ECU 3 starts applying a current to the first electromagnetic solenoid 42A at time t16. By applying a current to the first electromagnetic solenoid 42A, the first switching pin 41A moves down such that the lower end portion is fitted to the first slide groove 13A. As a result, the outer cam shaft 32 starts sliding along the first slide groove 13A, that is, starts sliding in the angle range from the cam angle θ3 to the cam angle θ4 such that a relative position between the intake cam 11 and the rocker roller 51A changes. Specifically, the intake cam 11 is moved such that a part of the rocker roller 51A is positioned on the standard intake cam 15 from a state where the rocker roller 51A and the low-speed cam 16 are in contact with each other.

Here, as illustrated in FIG. 6A, in the angle range from the cam angle θ3 to the cam angle θ4, the cam lift amount of the low-speed cam 16 is greater than that of the standard intake cam 15. That is, the standard intake cam 15 is positioned at a position (position close to the rotation center) lower than the low-speed cam 16. Therefore, the intake cam 11 can be smoothly slid without being hindered by a step difference between a cam surface of the low-speed cam 16 and a cam surface of the standard intake cam 15. The opening and closing operation of the intake valve V1 included in each of the cylinders is stopped. Therefore, even in a case where the rocker roller 51A falls from the step difference between the low-speed cam 16 and the standard intake cam 15, the rocker arm 51 moves in the up-down direction together with the bracket 52 such that the swinging of the rocker arm 51 is absorbed. As a result, the cam can be switched while preventing the generation of an abnormal sound.

As can be seen from FIG. 6A, the cam lift amounts of the intake cams 11 of the second cylinder #2 and the third cylinder #3 are zero in the angle range of the cam angle θ3 to the cam angle θ4. That is, the base circles of the intake cams 11 come into contact with the rocker roller 51A. Therefore, the intake cams 11 of the second cylinder #2 and the third cylinder #3 can be smoothly switched to the standard intake cams 15 as long as at least a part of the rocker roller 51A is positioned on the standard intake cam 15 up to the cam angle θ4.

Figure 8:
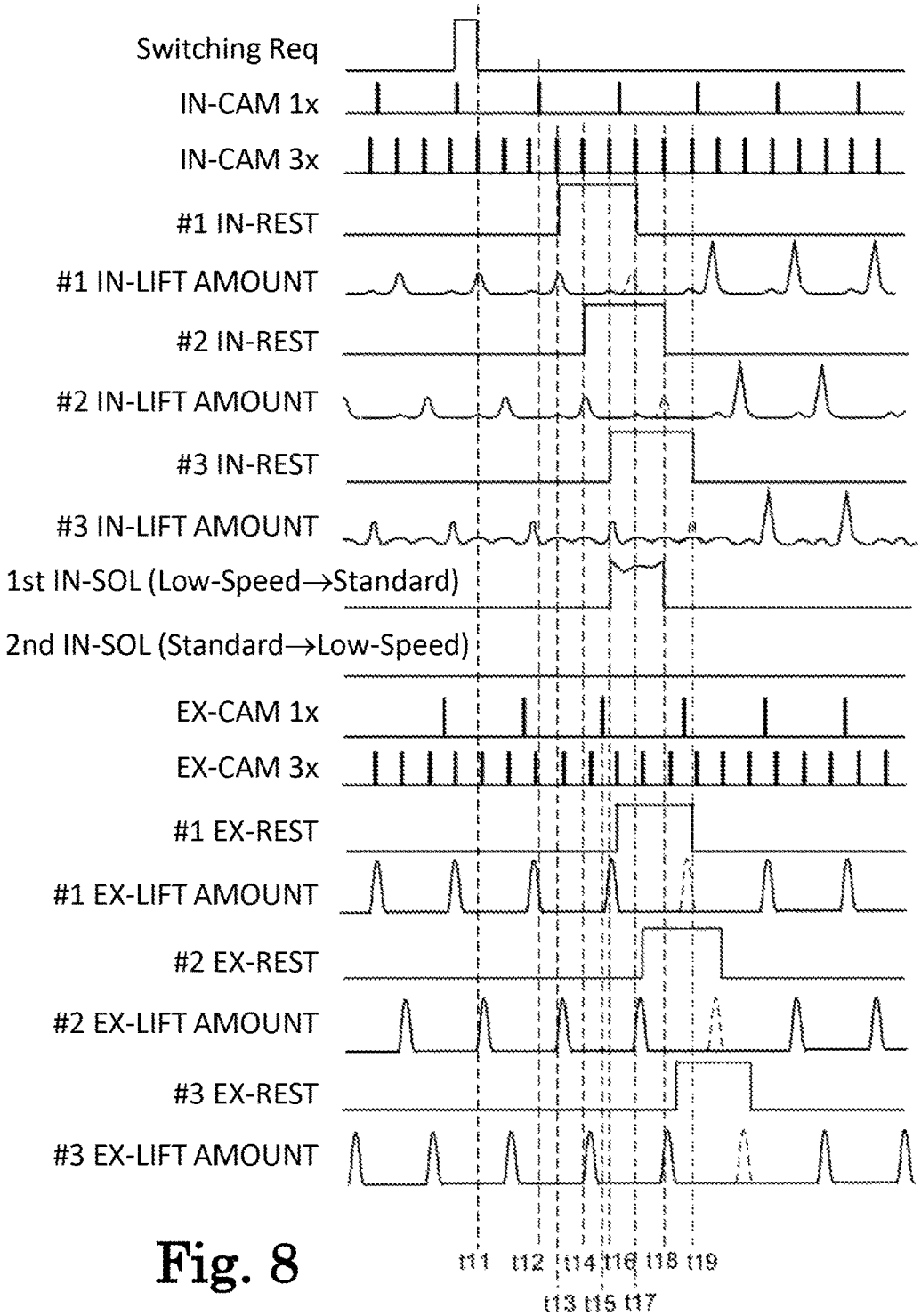
FIG. 8 is a timing chart illustrating switching from the low-speed cam to the standard cam in the intake cam.

Next, as illustrated in FIG. 8, at time t17, current carrying to the electromagnetic solenoid 55 for resting corresponding to the intake valve V1 of the first cylinder #1 is stopped, and the intake valve V1 is switched to an operation state. At this time, at least a part of the rocker roller 51A is positioned on the standard intake cam 15. As a result, the opening and closing operation of the intake valve V1 of the first cylinder #1 starts smoothly according to the cam profile of the standard intake cam 15.

Next, at time t18, current carrying to the electromagnetic solenoid 55 for resting corresponding to the intake valve V1 of the second cylinder #2 is stopped. At time t19, current carrying to the electromagnetic solenoid 55 for resting corresponding to the intake valve V1 of the third cylinder #3 is stopped, and the intake valve V1 included in each of the cylinders #2 and #3 is switched to an operation state. Regarding the cylinders #2 and #3, at least a part of the rocker roller 51A is positioned on the standard intake cam 15. Therefore, the opening and closing operation of the intake valve V1 starts smoothly according to the cam profile of the standard intake cam 15.

In addition, in a case where the ECU 3 recognizes that an intake control start timing of the next period is reached based on the timing signal IN-CAM1*x* (at time t12), the ECU recognizes that an exhaust control start timing of the next period is reached based on the timing signal EX-CAM1*x*. Here, the intake control of the next period and the exhaust control of the next period are an intake control and an exhaust control in the same combustion cycle.

In a case where the ECU 3 recognizes that an exhaust control start timing of the next period is reached based on the timing signal EX-CAM1*x* (at time t15), the ECU sequentially applies a current to the electromagnetic solenoid 55 for resting corresponding to the exhaust valve V2 of the first cylinder #1, the electromagnetic solenoid 55 for resting corresponding to the exhaust valve V2 of the second cylinder #2, and the electromagnetic solenoid 55 for resting corresponding to the exhaust valve V2 of the third cylinder #3 based on the timing signal EX-CAM3*x*. As a result, regarding the first cylinder #1, the second cylinder #2, and the third cylinder #3, even in a case where the rocker arm 51 swings, the exhaust valve V2 is maintained in a closed state.

Next, the ECU sequentially stops current carrying to the electromagnetic solenoid 55 for resting corresponding to the exhaust valve V2 of the first cylinder #1, the electromagnetic solenoid 55 for resting corresponding to the exhaust valve V2 of the second cylinder 42, and the electromagnetic solenoid 55 for resting corresponding to the exhaust valve V2 of the third cylinder #3, and the exhaust valve V2 is switched to an operation state.

In a case where the operation of the intake valve V1 is stopped in the switching control from the low-speed cam 16 to the standard intake cam 15, the operation of the exhaust valve V2 in the same combustion cycle can be appropriately stopped. That is, in a combustion cycle in which the intake valve V1 does not operate and air is not taken in, the exhaust valve V2 does not operate. As a result, the backflow of exhaust gas from an exhaust downstream side into a combustion chamber can be prevented, the backflow being caused when the exhaust valve V2 opens although air is not taken in in the combustion cycle. Therefore, a rotational resistance to the engine can be prevented, and deterioration of fuel efficiency can be prevented.

Next, a switching control from the fast-opening cam 25 to the standard exhaust cam 26 will be described with reference to FIG. 9. In a timing chart of FIG. 9, the horizontal axis represents the time. Among respective items of the vertical axis in a timing chart of FIG. 9, the same items as those of FIG. 7 will not be described.

Switching Req (switching request signal) is a timing signal representing a switching request from the fast-opening cam 25 to the standard exhaust cam 26. First EX-SOL is a signal representing the capacity of a current applied to the first electromagnetic solenoid 42A of the exhaust-side electromagnetic solenoid 24. Second EX-SOL is a signal representing the capacity of a current applied to the second electromagnetic solenoid 42B of the exhaust-side electromagnetic solenoid 24. In the example of FIG. 9, the exhaust cam is switched from the fast-opening cam 25 to the standard exhaust cam 26, and thus a current is applied to the second electromagnetic solenoid 42B of the exhaust-side electromagnetic solenoid 24.

The ECU 3 monitors the switching request signal and recognizes that a switching request from the fast-opening cam 25 to the standard exhaust cam 26 is given based on a change in the voltage level of the switching request signal. In the example of FIG. 9, the ECU 3 recognizes that the switching request is given at a falling timing (time t21) from an H-level to an L-level.

In a case where the switching request from the fast-opening cam 25 to the standard exhaust cam 26 is recognized, the ECU 3 sequentially makes the intake valve V1 each of the cylinders #1 to #3 rest. Therefore, in a case where the ECU 3 recognizes that an intake control start timing of the next period is reached based on the timing signal IN-CAM1*x* (at time t22), the ECU 3 sequentially applies a current to the electromagnetic solenoid 55 for resting corresponding to the intake valve V1 of the first cylinder #1, the electromagnetic solenoid 55 for resting corresponding to the intake valve V1 of the second cylinder #2, and the electromagnetic solenoid 55 for resting corresponding to the intake valve V1 of the third cylinder #3 based on the timing signal IN-CAM3*x*. As a result, regarding the first cylinder #1, the second cylinder #2, and the third cylinder #3, even in a case where the rocker arm 51 swings, the intake valve V1 is maintained in a closed state.

Next, the ECU sequentially stops current carrying to the electromagnetic solenoid 55 for resting corresponding to the intake valve V1 of the first cylinder #1, the electromagnetic solenoid 55 for resting corresponding to the intake valve V1 of the second cylinder #2, and the electromagnetic solenoid 55 for resting corresponding to the intake valve V1 of the third cylinder #3, and the intake valve V1 is switched to an operation state.

In addition, in a case where the ECU 3 recognizes that an intake control start timing of the next period is reached based on the timing signal IN-CAM1*x* (at time t22), the ECU 3 recognizes that an exhaust control start timing of the next period is reached based on the timing signal EX-CAM1*x*. Here, the intake control of the next period and the exhaust control of the next period are an intake control and an exhaust control in the same combustion cycle.

In a case where the ECU 3 recognizes that an exhaust control start timing of the next period is reached based on the timing signal EX-CAM1*x* (time t23), the ECU 3 applies a current to the electromagnetic solenoid 55 for resting corresponding to the exhaust valve V2 of the first cylinder #1 based on the timing signal EX-CAM3*x* (time t24). As a result, regarding the first cylinder 41, even in a case where the rocker arm 51 swings, the exhaust valve V2 is maintained in a closed state.

Next, the ECU 3 applies a current to the electromagnetic solenoid 55 for resting corresponding to the exhaust valve V2 of the second cylinder #2 based on the timing signal EX-CAM3*x* (time t25). As a result, regarding the second cylinder 42, even in a case where the rocker arm 51 swings, the exhaust valve V2 is maintained in a closed state. Likewise, the ECU 3 applies a current to the electromagnetic solenoid 55 for resting corresponding to the exhaust valve V2 of the third cylinder 43 based on the timing signal EX-CAM3*x* (time t26). As a result, regarding the third cylinder #3, even in a case where the rocker arm 51 swings, the exhaust valve V2 is maintained in a closed state. At time t26, the exhaust valve V2 of each of the cylinders #1 to #3 is made to rest.

The ECU 3 starts applying a current to the second electromagnetic solenoid 42B of the exhaust-side electromagnetic solenoid 24 at time t26. By applying a current to the second electromagnetic solenoid 42B, the second switching pin 41B moves down such that the lower end portion is fitted to the second slide groove of the exhaust-side slide groove 23. As a result, the outer cam shaft of the exhaust-side dual cam shaft 22 starts sliding along the second slide groove, that is, starts sliding in the angle range from the cam angle θ12 to the cam angle θ13 such that a relative position between the exhaust cam 21 and the rocker roller 51A changes. Specifically, the exhaust cam 21 is moved such that a part of the rocker roller 51A is positioned on the standard exhaust cam 26 from a state where the rocker roller 51A and the fast-opening cam 25 are in contact with each other.

Here, as illustrated in FIG. 6B, in the angle range from the cam angle θ12 to the cam angle θ13, the cam lift amount of the fast-opening cam 25 is greater than that of the standard exhaust cam 26. That is, the standard exhaust cam 26 is positioned at a position (position close to the rotation center) lower than the fast-opening cam 25. Therefore, the exhaust cam 21 can be smoothly slid without being hindered by a step difference between a cam surface of the fast-opening cam 25 and a cam surface of the standard exhaust cam 26. The opening and closing operation of the exhaust valve V2 included in each of the cylinders is stopped. Therefore, even in a case where the rocker roller 51A falls from the step difference between the fast-opening cam 25 and the standard exhaust cam 26, the rocker arm 51 moves in the up-down direction together with the bracket 52 such that the swinging of the rocker arm 51 is absorbed. As a result, the cam can be switched while preventing the generation of an abnormal sound.

As can be seen from FIG. 6B, the cam lift amounts of the exhaust cams 21 of the second cylinder #2 and the third cylinder #3 are zero in the angle range of the cam angle θ12 to the cam angle θ13. That is, the base circles of the exhaust cams 21 come into contact with the rocker roller 51A. Therefore, the exhaust cams 21 of the second cylinder #2 and the third cylinder #3 can be switched from the fast-opening cam 25 to the standard exhaust cam 26.

Figure 9:
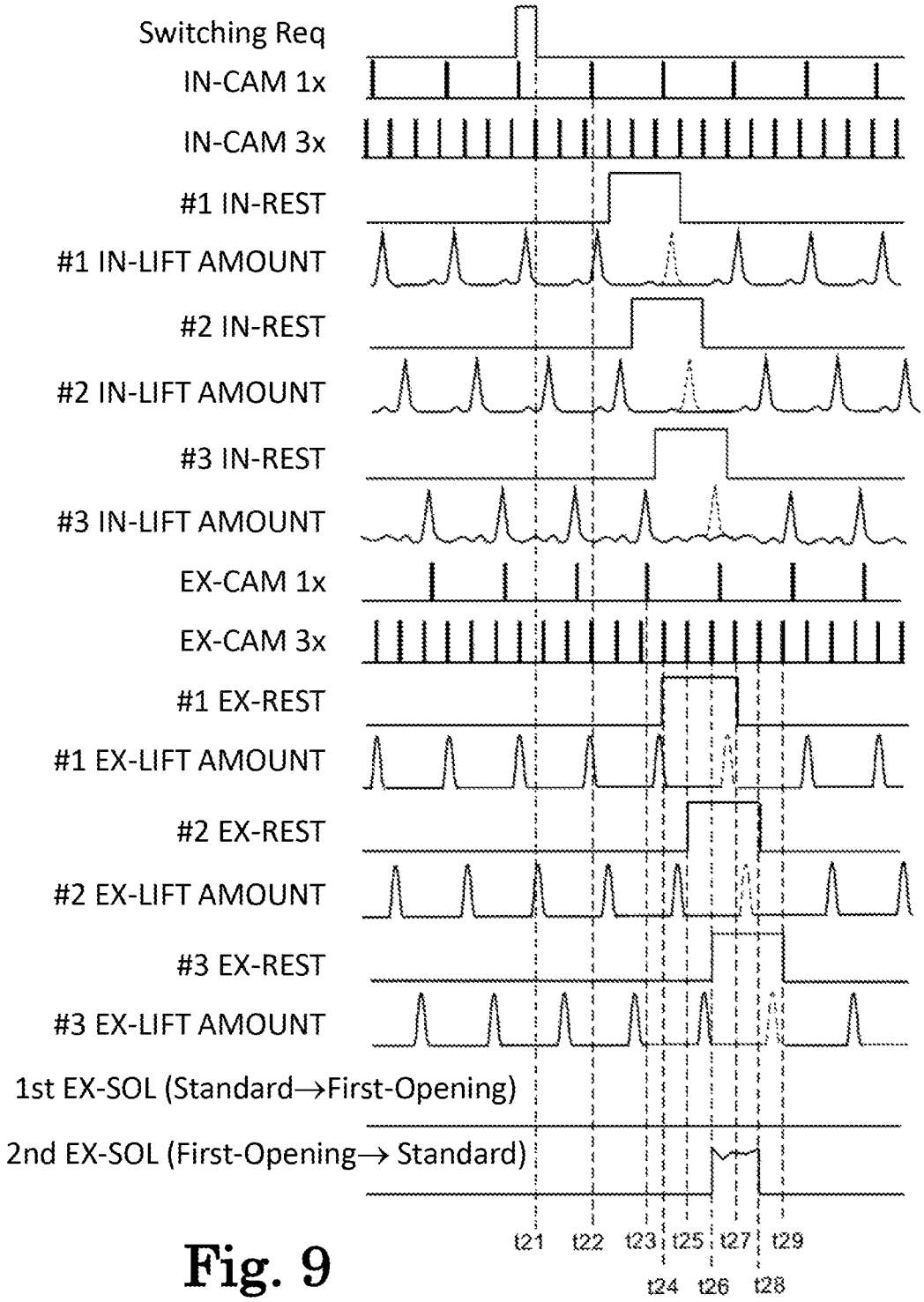
FIG. 9 is a timing chart illustrating switching from a fast-opening cam to a standard cam in the exhaust cam.

Next, as illustrated in FIG. 9, at time t27, current carrying to the electromagnetic solenoid 55 for resting corresponding to the exhaust valve V2 of the first cylinder #1 is stopped, and the exhaust valve V2 is switched to an operation state. At this time, at least a part of the rocker roller 51A is positioned on the standard exhaust cam 26. As a result, the opening and closing operation of the exhaust valve V2 of the first cylinder #1 starts smoothly according to the cam profile of the standard exhaust cam 26.

Next, at time t28, current carrying to the electromagnetic solenoid 55 for resting corresponding to the exhaust valve V2 of the second cylinder #2 is stopped. At time t29, current carrying to the electromagnetic solenoid 55 for resting corresponding to the exhaust valve V2 of the third cylinder #3 is stopped, and the exhaust valve V2 included in each of the cylinders #2 and #3 is switched to an operation state. Regarding the cylinders #2 and #3, at least a part of the rocker roller 51A is positioned on the standard exhaust cam 26. Therefore, the opening and closing operation of the exhaust valve V2 starts smoothly according to the cam profile of the standard exhaust cam 26.

In a case where the operation of the exhaust valve V2 is stopped in the switching control from the fast-opening cam 25 to the standard exhaust cam 26, the operation of the intake valve V1 in the same combustion cycle that is performed therebefore can be appropriately stopped. That is, in the combustion cycle of stopping the exhaust valve V1, air intake caused by the operation of the intake valve V1 can be appropriately prevented. As a result, the piston does not move while the taken air remains in the combustion chamber. Therefore, an increase in the rotational resistance of the engine can be prevented, and deterioration of fuel efficiency can be prevented. In addition, the taken air is not exhausted from the combustion chamber, and the intake step of the next combustion cycle is not performed. Therefore, in the intake step of the next combustion cycle, air which is taken in does not collide against air which escapes from the inside of the combustion chamber to the intake side, and the generation of an abnormal sound can be appropriately prevented.

Next, a switching control from the standard exhaust cam 26 to the fast-opening cam 25 will be described with reference to FIG. 10. Among respective items of the horizontal axis and the vertical axis in a timing chart of FIG. 10, the same items as those of FIG. 9 will not be described.

Switching Req (switching request signal) is a timing signal representing a switching request from the standard intake cam 15 to the low-speed cam 16.

The ECU 3 monitors the switching request signal and recognizes that a switching request from the standard exhaust cam 26 to the fast-opening cam 25 is given based on a change in the voltage level of the switching request signal. In the example of FIG. 10, the ECU 3 recognizes that the switching request is given at a falling timing (time t31) from an H-level to an L-level.

In a case where the switching request from the standard exhaust cam 26 to the fast-opening cam 25 is recognized, the ECU 3 sequentially makes each of the cylinders #1 to #3 rest. Therefore, in a case where the ECU 3 recognizes that an intake control start timing of the next period is reached based on the timing signal IN-CAM1*x* (at time t32), the ECU 3 sequentially applies a current to the electromagnetic solenoid 55 for resting corresponding to the intake valve V1 of the first cylinder #1, the electromagnetic solenoid 55 for resting corresponding to the intake valve V1 of the second cylinder #2, and the electromagnetic solenoid 55 for resting corresponding to the intake valve V1 of the third cylinder #3 based on the timing signal IN-CAM3*x*. As a result, regarding the first cylinder #1, the second cylinder #2, and the third cylinder #3, even in a case where the rocker arm 51 swings, the intake valve V1 is maintained in a closed state.

Next, the ECU sequentially stops current carrying to the electromagnetic solenoid 55 for resting corresponding to the intake valve V1 of the first cylinder #1, the electromagnetic solenoid 55 for resting corresponding to the intake valve V1 of the second cylinder #2, and the electromagnetic solenoid 55 for resting corresponding to the intake valve V1 of the third cylinder #3, and the intake valve V1 is switched to an operation state.

In addition, in a case where the ECU 3 recognizes that an intake control start timing of the next period is reached based on the timing signal IN-CAM1*x* (at time t32), the ECU 3 recognizes that an exhaust control start timing of the next period is reached based on the timing signal EX-CAM1*x*. Here, the intake control of the next period and the exhaust control of the next period are an intake control and an exhaust control in the same combustion cycle.

In a case where the ECU 3 recognizes that an exhaust control start timing of the next period is reached based on the timing signal EX-CAM1*x* (at time t33), the ECU 3 sequentially makes each of the cylinders rest. Therefore, the ECU 3 applies a current to the electromagnetic solenoid 55 for resting corresponding to the exhaust valve V2 of each of the cylinders #1 to #3 based on the timing signal EX-CAM3*x* (times t34 to t36).

The ECU 3 starts applying a current to the first electromagnetic solenoid 42A at time t36. By applying a current to the first electromagnetic solenoid 42A, the first switching pin 41A moves down such that the lower end portion is fitted to the first slide groove of the exhaust-side slide groove 23. As a result, the outer cam shaft of the exhaust-side dual cam shaft 22 starts sliding along the first slide groove, that is, starts sliding in the angle range from the cam angle θ13 to the cam angle θ14 such that a relative position between the exhaust cam 21 and the rocker roller 51A changes. Specifically, the exhaust cam 21 is moved such that a part of the rocker roller 51A is positioned on the fast-opening cam 25 from a state where the rocker roller 51A and the standard exhaust cam 26 are in contact with each other.

Here, as illustrated in FIG. 6B, in the angle range from the cam angle θ13 to the cam angle θ14, the cam lift amount of the standard exhaust cam 26 is greater than that of the fast-opening cam 25. That is, the fast-opening cam 25 is positioned at a position (position close to the rotation center) lower than the standard exhaust cam 26. Therefore, the exhaust cam 21 can be smoothly slid without being hindered by a step difference between a cam surface of the standard exhaust cam 26 and a cam surface of the fast-opening cam 25. The opening and closing operation of the exhaust valve V2 included in each of the cylinders is stopped. Therefore, even in a case where the rocker roller 51A falls from the step difference between the standard exhaust cam 26 and the fast-opening cam 25, the rocker arm 51 moves in the up-down direction together with the bracket 52 such that the swinging of the rocker arm 51 is absorbed. As a result, the cam can be switched while preventing the generation of an abnormal sound.

As can be seen from FIG. 6B, the cam lift amounts of the exhaust cams 21 of the second cylinder #2 and the third cylinder #3 are zero in the angle range of the cam angle θ13 to the cam angle θ14. That is, the base circles of the exhaust cams 21 come into contact with the rocker roller 51A. Therefore, the exhaust cams 21 of the second cylinder #2 and the third cylinder #3 can be smoothly switched to the fast-opening cams 25 as long as at least a part of the rocker roller 51A is positioned on the fast-opening cam 25 up to the cam angle θ14.

Figure 10:
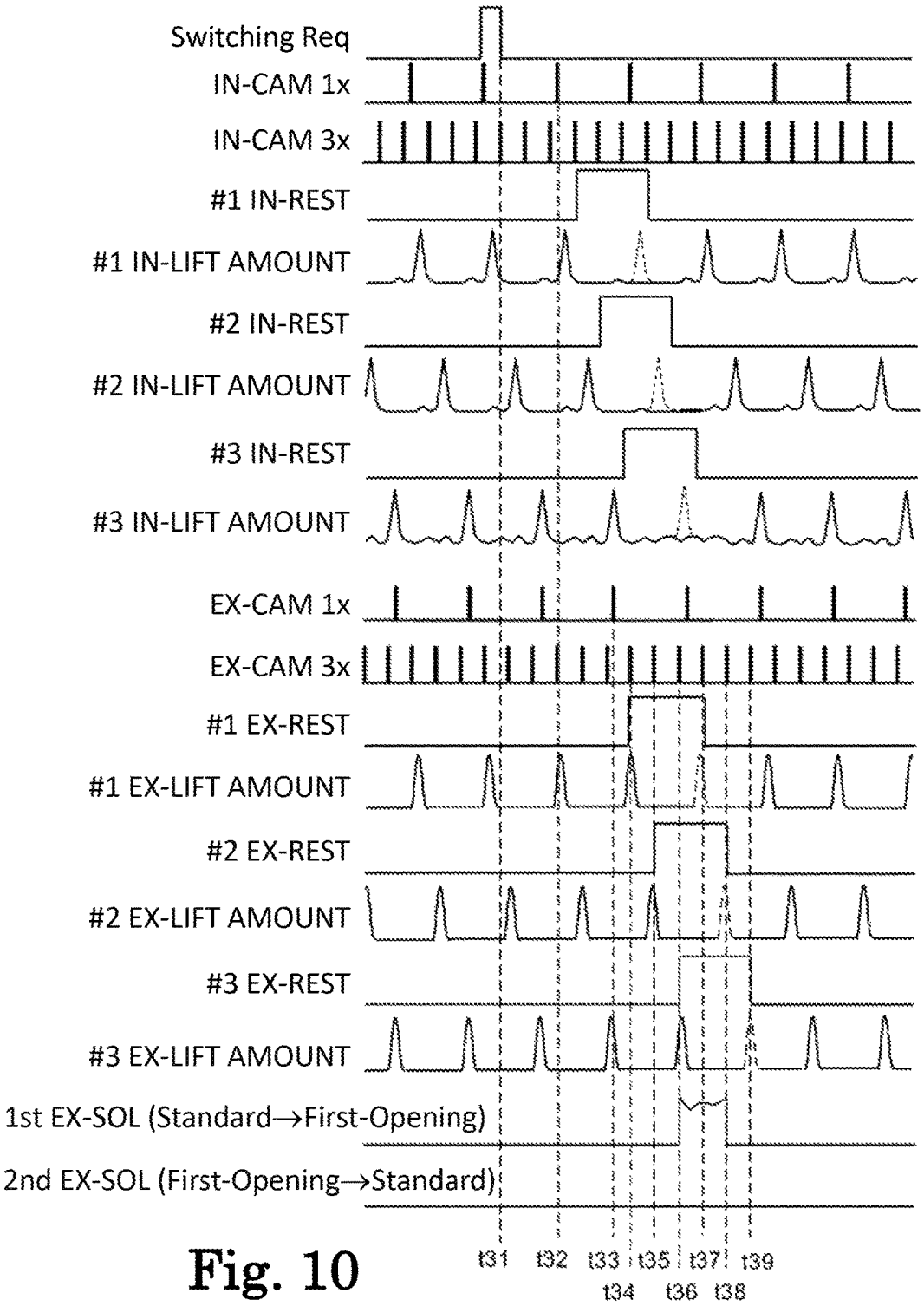
FIG. 10 is a timing chart illustrating switching from the standard cam to the fast-opening cam in the exhaust cam.

Next, as illustrated in FIG. 10, at time t37, current carrying to the electromagnetic solenoid 55 for resting corresponding to the exhaust valve V2 of the first cylinder 41 is stopped, and the exhaust valve V2 is switched to an operation state. At this time, at least a part of the rocker roller 51A is positioned on the fast-opening cam 25. As a result, the opening and closing operation of the exhaust valve V2 of the first cylinder #1 starts smoothly according to the cam profile of the fast-opening cam 25.

Next, at time t38, current carrying to the electromagnetic solenoid 55 for resting corresponding to the exhaust valve V2 of the second cylinder #2 is stopped. At time t39, current carrying to the electromagnetic solenoid 55 for resting corresponding to the exhaust valve V2 of the third cylinder #3 is stopped, and the exhaust valve V2 included in each of the cylinders #2 and #3 is switched to an operation state. Regarding the cylinders #2 and #3, at least a part of the rocker roller 51A is positioned on the fast-opening cam 25. Therefore, the opening and closing operation of the exhaust valve V2 starts smoothly according to the cam profile of the fast-opening cam 25.

In a case where the operation of the exhaust valve V2 is stopped in the switching control from the standard exhaust cam 26 to the fast-opening cam 25, the operation of the intake valve V1 in the same combustion cycle that is performed therebefore can be appropriately stopped. That is, in the combustion cycle of stopping the exhaust valve V1, air intake caused by the operation of the intake valve V1 can be appropriately prevented. As a result, the piston does not move while the taken air remains in the combustion chamber. Therefore, an increase in the rotational resistance of the engine can be prevented, and deterioration of fuel efficiency can be prevented. In addition, the taken air is not exhausted from the combustion chamber, and the intake step of the next combustion cycle is not performed. Therefore, in the intake step of the next combustion cycle, air which is taken in does not collide against air which escapes from the inside of the combustion chamber to the intake side, and the generation of an abnormal sound can be appropriately prevented.

As described above, the engine 100 according to the embodiment includes the cam switching mechanism 1 that selectively switches between a pair of cams included in the intake cam 11 or the exhaust cam 21 according to an operation state of the engine 100. In addition, in each of cylinders of the engine 100, the cylinder resting mechanism 2 that stops the opening and closing operations of the intake and exhaust valves V1 and V2 to make the cylinder rest is provided.

The cam profile of the standard intake cam 15 included in the intake cam 11 or the fast-opening cam 25 (the first cam) included in the exhaust cam 21, and the cam profile of the low-speed cam 16 included in the intake cam 11 or the standard exhaust cam 26 (the second cam) included in the exhaust cam 21 are determined, respectively, such that the first cam angle range where the valve lift amounts of the standard intake cam 15 and the fast-opening cam 25 are greater than those of the low-speed cam 16 and the standard exhaust cam 26 and the second cam angle range where the valve lift amounts of the low-speed cam 16 and the standard exhaust cam 26 are greater than those of the standard intake cam 15 and the fast-opening cam 25 are formed.

During switching from the standard intake cam 15 or the fast-opening cam 25 to the low-speed cam 16 or the standard exhaust cam 26, the set (cylinder resting unit) of the cylinder resting mechanism 2 and the ECU 3 controls to stop the opening and closing operations of the intake and exhaust valves V1 and V2, and the set (cam switching unit) of the cam switching mechanism 1 and the ECU 3 controls to start sliding the outer cam shaft 32 in the first cam angle range that is set for the first cam and the second cam corresponding to one cylinder and is a range where valve lift amounts of the first cam and the second cam corresponding to another cylinder are zero. During switching from the low-speed cam 16 or the standard exhaust cam 26 to the standard intake cam 15 or the fast-opening cam 25, the set of the cylinder resting mechanism 2 and the ECU 3 controls to stop the opening and closing operations of the intake and exhaust valves V1 and V2, and the set of the cam switching mechanism 1 and the ECU 3 controls to start sliding the outer cam shaft 32 in the second cam angle range that is set for the first cam and the second cam corresponding to one cylinder and is a range where valve lift amounts of the first cam and the second cam corresponding to another cylinder are zero.

As a result, the intake cam 11 or the exhaust cam 21 can be slide without being hindered by the step difference between the standard intake cam 15 and the low-speed cam 16 or the step difference between the fast-opening cam 25 and the standard exhaust cam 26. As a result, in the intake cam 11 or the exhaust cam 21, switching between the cams can be performed even in a case where the angle range of the base circle is insufficient for switching between the cams.

In addition, in the embodiment, when the intake cam 11 is switched, not only the operation of the intake valve V1 but also the operation of the exhaust valve V2 in the same combustion cycle are stopped. Therefore, the backflow of exhaust gas from an exhaust downstream side into a combustion chamber can be prevented, the backflow being caused when the exhaust valve V2 opens although air is not taken in in the combustion cycle. Therefore, a rotational resistance to the engine can be prevented, and deterioration of fuel efficiency can be prevented.

In addition, in the embodiment, when the exhaust cam 21 is switched, the operations of the intake valve V1 and the exhaust valve V2 relating to the same combustion cycle are stopped. As a result, the piston does not move while the taken air remains in the combustion chamber without being exhausted. Therefore, an increase in the rotational resistance of the engine can be prevented, and deterioration of fuel efficiency can be prevented. In addition, the taken air is not exhausted from the combustion chamber, and the intake step of the next combustion cycle is not performed. Therefore, in the intake step of the next combustion cycle, air which is taken in does not collide against air which escapes from the inside of the combustion chamber to the intake side, and the generation of an abnormal sound can be appropriately prevented.

The description of the embodiment is for easy understanding of the present disclosure and does not limit the present invention. Changes and modifications can be made within a range not departing from the scope of the present invention, and the present invention includes equivalents thereof.

For example, in the embodiment, the cam profiles are determined such that a cam angle at which the valve lift amounts of the first cam and the second cam corresponding to another cylinder are not zero is present in the first cam angle range (the second cam angle range) of the first cam and the second cam corresponding to one cylinder. Therefore, the outer cam shaft starts sliding in a range narrower than the first cam angle range (second cam angle range). However, in a case where the valve lift amounts of the first cam and the second cam corresponding to another cylinder are typically zero in the first cam angle range (second cam angle range) of the first cam and the second cam corresponding to one cylinder, the outer cam shaft can start sliding at any angle in the first cam angle range (the second cam angle range).

In addition, the engine 100 is not limited to a three-cylinder engine as long as it includes plural cylinders. The present invention is applicable to a configuration in which an angle range of a base circle is insufficient for switching between cams in terms of cam profiles. In addition, the cylinder resting mechanism 2 is not limited to the example of the embodiment. The present invention is applicable to any cylinder resting mechanism as long as the cylinder resting mechanism can make each of cylinders rest.

In addition, in the embodiment, the dual cam shaft including the outer cam shaft 32 that is movable in the axis direction on the outer periphery of the inner cam shaft 31 is adopted, but the present invention is not limited thereto. The first cam and the second cam are provided to be rotatable together, and may have any structure as long as they are movable in the axis direction.

The present application is based on Japanese Patent Application No. 2016-003840 filed on Jan. 12, 2016, the entire contents of which are incorporated herein by reference.

INDUSTRIAL APPLICABILITY

The cam-switching device and the method of controlling the cam-switching device according to the present disclosure are useful in that switching between cams can be performed even in a case where an angle range of a base circle is insufficient for switching between the cams.

LIST OF REFERENCE NUMERALS

1: Cam switching mechanism
2: Cylinder resting mechanism
3: ECU
10: Intake-side cam switching mechanism
11: Intake cam
12: Intake-side dual cam shaft
13: Intake-side slide groove
13A: First slide groove
13B: Second slide groove
14: Intake-side electromagnetic solenoid
15: Standard intake cam
16: Low-speed cam
20: Exhaust-side cam switching mechanism
21: Exhaust cam
22: Exhaust-side dual cam shaft
23: Exhaust-side slide groove
24: Exhaust-side electromagnetic solenoid
25: Fast-opening cam
26: Standard exhaust cam
31: Inner cam shaft
32: Outer cam shaft
41A: First switching pin
41B: Second switching pin
43A: First iron core
43B: Second iron core
44A: First permanent magnet
44B: Second permanent magnet
45: Yoke
51: Rocker arm
51A: Rocker roller
51B: Rocker shaft axis
52: Bracket
52A: Needle storage space
52B: Piston portion
52C: Oil gallery
52D: Communication hole
53: Hydraulic tappet
53A: Body
53B: Check ball
53C: Storage portion
53D: Piston spring
54: Needle
55: Electromagnetic solenoid for resting
55A: Guide shaft
55B: Coil for resting
55C: Plunger
55D: Plunger storage space
55E: Needle storage space
55F: Guide space
100: Engine
OL: Oil passage
V1: Intake valve
V2: Exhaust valve

The invention claimed is:

1. A cam-switching device that selectively switches between a first cam and a second cam to make valve characteristics of intake and exhaust valves of an engine variable, the first cam and the second cam being provided corresponding to each of the intake and exhaust valves and having different cam profiles, each of the cam profiles being determined such that a first cam angle range where a valve lift amount of the first cam is greater than a valve lift amount of the second cam and a second cam angle range where a valve lift amount of the second cam is greater than a valve lift amount of the first cam are formed, and the cam-switching device comprising:

a cam shaft configured to rotate in conjunction with a crank shaft of the engine and provided such that the first cam and the second cam rotate together;

a cam shaft moving unit comprising an intake-side slide groove and an intake-side electromagnetic solenoid, and an exhaust-side slide groove and an exhaust-side electromagnetic solenoid, configured to slide the cam shaft in an axial direction to selectively switch between the first cam and the second cam;

a cylinder resting unit comprising a rocker arm, a bracket, a hydraulic tappet, a needle, and a third electromagnetic solenoid, configured to stop opening and closing operations of the intake and exhaust valves to deactivate a cylinder; and an electronic control unit (ECU) configured to control the cylinder resting unit to stop the opening and closing operations of the intake and exhaust valves in a same combustion cycle and control the cam shaft moving unit to start sliding the cam shaft in the first cam angle range in a case of switching from the first cam to the second cam, and to control the cylinder resting unit to stop the opening and closing operations of the intake and exhaust valves in the same combustion cycle and control the cam shaft moving unit to start sliding the cam shaft in the second cam angle range in a case of switching from the second cam to the first cam.

2. The cam-switching device according to claim 1, further comprising:

the rocker arm configured to swing according to the cam profiles of the first cam and the second cam and presses the intake and exhaust valves against a restoring force of a valve spring, wherein the cylinder resting unit causes the rocker arm to swing around a point contacting the intake and exhaust valves as a fulcrum.

3. The cam-switching device according to claim 1, wherein the engine is an inline multi-cylinder engine comprising a plurality of first and second cams, in which plural cylinders are arranged in line, wherein the plurality of the first cams and the plurality of the second cams respectively correspond to each of the intake and exhaust valves of the plural cylinders, the ECU controls the cylinder resting unit to stop the opening and closing operations of the intake and exhaust valves provided in the plural cylinders in the same combustion cycle, and control the cam shaft moving unit to start sliding the cam shaft in the axial direction in the first cam angle range that is set for the first cam and the second cam corresponding to one cylinder of the plural cylinders and the first cam angle range is a range where valve lift amounts of the first cam and the second cam corresponding to another cylinder of the plural cylinders are zero, in a case of switching from the first cam to the second cam, and the ECU controls the cylinder resting unit to stop the opening and closing operations of the intake and exhaust valves provided in the plural cylinders in the same combustion cycle, and control the cam shaft moving unit to start sliding the cam shaft in the axial direction in the second cam angle range that is set for the first cam and the second cam corresponding to the one cylinder, and the second can angle range is a range where valve lift amounts of the first cam and the second cam corresponding to the another cylinder are zero, in a case of switching from the second cam to the first cam.

4. A method of controlling a cam-switching device including a first cam and a second cam provided to each of intake and exhaust valves of an engine and having different cam profiles, each of the cam profiles being determined such that a first cam angle range where a valve lift amount of the first cam is greater than a valve lift amount of the second cam and a second cam angle range where a valve lift amount of the second cam is greater than a valve lift amount of the first cam are formed, a cam shaft configured to rotate in conjunction with a crank shaft of the engine and provided such that the first cam and the second cam are rotatable together, a cam shaft moving unit comprising an intake-side slide groove and an intake-side electromagnetic solenoid, and an exhaust-side slide groove and an exhaust-side electromagnetic solenoid, configured to slide the cam shaft in an axial direction to selectively switch between the first cam and the second cam, and a cylinder resting unit comprising a rocker arm, a bracket, a hydraulic tappet, a needle, and an electromagnetic solenoid, configured to stop opening and closing operations of the intake and exhaust valves, the method comprising:

stopping the opening and closing operations of the intake and exhaust valves in a same combustion cycle and start sliding the cam shaft in the first cam angle range in a case of switching from the first cam to the second cam; and stopping the opening and closing operations of the intake and exhaust valves in a same combustion cycle and start sliding the cam shaft in the second cam angle range in a case of switching from the second cam to the first cam.

* * * * *